US011708948B2

(12) United States Patent
Sonneman et al.

(10) Patent No.: US 11,708,948 B2
(45) Date of Patent: Jul. 25, 2023

(54) MODULAR LIGHTING SYSTEM WITH SHARED STRUCTURAL COMPONENTS

(71) Applicant: Contemporary Visions, LLC, Larchmont, NY (US)

(72) Inventors: Robert A. Sonneman, Mamaroneck, NY (US); Nuno Pires Da Silva, Lisbon (PT)

(73) Assignee: CONTEMPORARY VISIONS, LLC, Larchmont, NY (US)

( * ) Notice: Subject to any disclaimer, the term of this patent is extended or adjusted under 35 U.S.C. 154(b) by 0 days.

(21) Appl. No.: 17/678,650

(22) Filed: Feb. 23, 2022

(65) Prior Publication Data

US 2023/0030164 A1 Feb. 2, 2023

Related U.S. Application Data

(60) Provisional application No. 63/199,394, filed on Dec. 23, 2020.

(51) Int. Cl.

| | |
|---|---|
| ***F21S 2/00*** | (2016.01) |
| ***F21V 21/008*** | (2006.01) |
| ***F21V 21/10*** | (2006.01) |

(52) U.S. Cl.
CPC ..... *F21S 2/005* (2013.01); *F21V 21/008* (2013.01); *F21V 21/10* (2013.01)

(58) Field of Classification Search
CPC ..... F21S 2/005; F21V 21/008; F21V 21/10
See application file for complete search history.

(56) References Cited

U.S. PATENT DOCUMENTS

| | | | | |
|---|---|---|---|---|
| 7,762,695 | B2 * | 7/2010 | Lanczy | F21V 21/005 362/217.13 |
| 2016/0146445 | A1 * | 5/2016 | Shine | F21K 9/20 362/249.02 |
| 2022/0057077 | A1 * | 2/2022 | Kinsley | F21V 23/02 |

* cited by examiner

*Primary Examiner* — Leah Simone Macchiarolo
(74) *Attorney, Agent, or Firm* — Gottlieb, Rackman & Reisman, PC

(57) ABSTRACT

A lighting system includes two or more three-dimensional structural frames that are joined to one another by at least one shared frame component and at least one shared connector to form a modular structural frame. The frames can be fitted with a light emitting panel for emitting light downwardly. The frames can be suspended from a ceiling via suspension cables or can be fixedly mounted to a ceiling.

10 Claims, 17 Drawing Sheets

MODULAR LIGHTING SYSTEM WITH SHARED STRUCTURAL COMPONENTS

CROSS-REFERENCE TO RELATED APPLICATION

This patent application claims priority under 35 U.S.C. § 119 to U.S. Provisional Patent Application No. 63/199,394, filed on Dec. 23, 2020, the disclosure of which is herein incorporated by reference in its entirety.

FIELD OF THE INVENTION

This present disclosure relates generally to a luminaire, and more specifically, to a scalable modular lighting system that that is configured to be hung from a surface (e.g., a ceiling or similar structure) and that can include a plurality of luminaires linked to each other by connecters that allows for an infinite variety of lighting configurations.

BACKGROUND OF THE INVENTION

Known modular lighting system come in various shapes and configurations ranging from a single lighting fixture to multiple lighting fixtures that are affixable to a surface (e.g., ceiling, wall or similar structure). However, such modular lighting systems do not allow for seamless and continuous electro-mechanical connectivity between luminaires that can be configured to be an array of possible arrangements.

SUMMARY OF THE INVENTION

In general, the present disclosure is directed to a modular lighting system of one or more luminaires that are fixable to a surface and can be adjoined to each other or similar structures by connectors to form a variety of scalable arrangements that project light therefrom. By adjusting the vertical position of cubes with respect to each other, an expansive horizontal and vertical array of configurations can be achieved. Each cube can support a horizontal LED light-guide or be left as an open frame, providing the flexibility to configure higher or lower density illumination and scale to a variety of spaces.

Low profile cubes allow for ceiling surface mounting or suspended installation where a minimal height is desired across the plane of a space. Used as single fixtures, clusters, or linear patterns, or configured for expansive arrangements across larger spaces, the lighting system expands the utility and aesthetic application of this lighting system.

Each cube can have a light panel at the bottom or be unlit. Surface mounted cubes can be full height, ⅔ height, or ⅓ height.

BRIEF DESCRIPTION OF THE DRAWINGS

The above and other features of the present invention will become more apparent by describing in detail exemplary embodiments thereof in conjunction with the accompanying drawings, in which.

DETAILED DESCRIPTION OF EMBODIMENTS OF THE INVENTION

Figure 1:
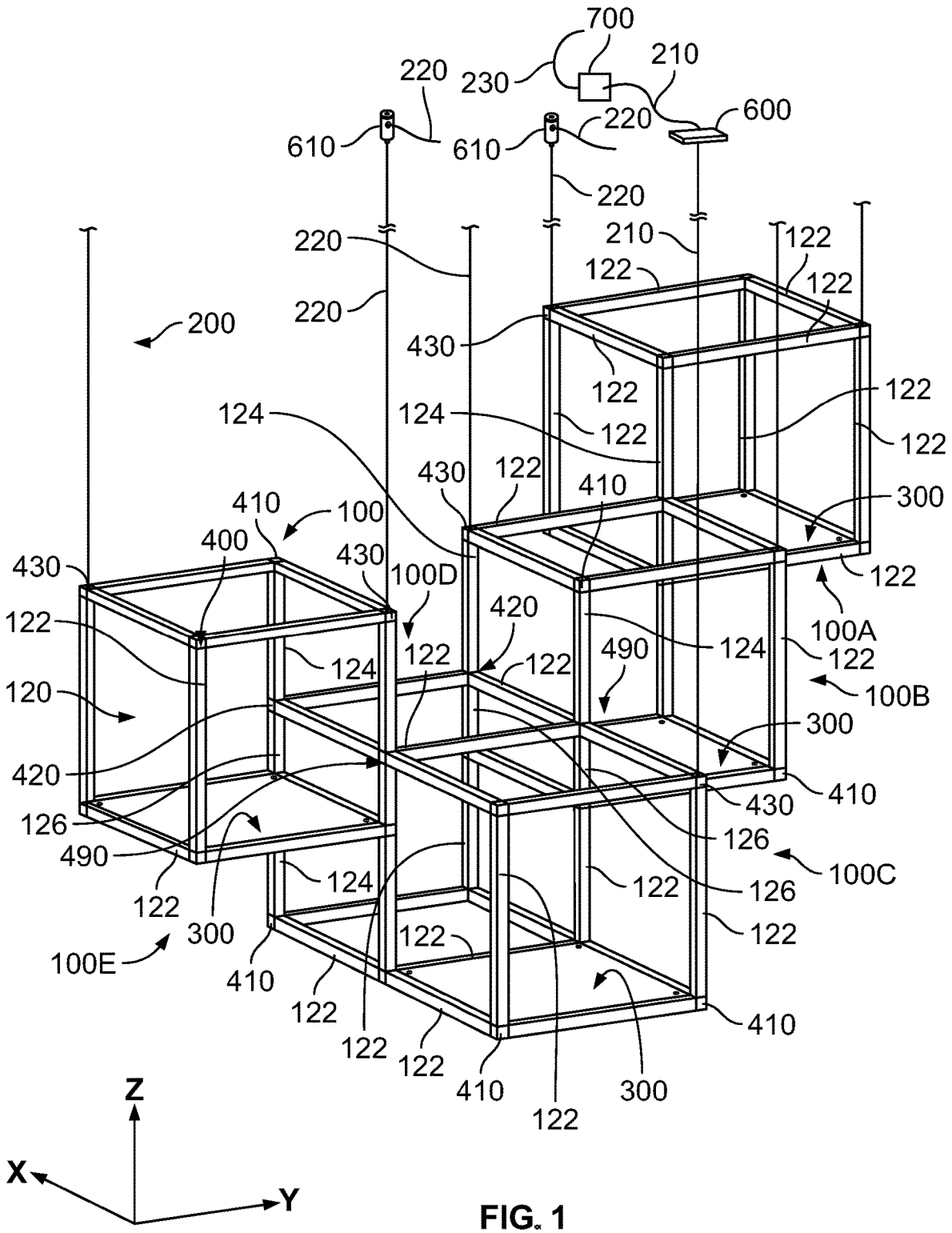
FIG. 1 is a perspective view illustrating a modular lighting system according to an exemplary embodiment of the present disclosure.

The present invention generally relates to a lighting system comprised of two or more three-dimensional structural frames that are joined to one another by at least one shared frame component to form a modular structural frame. The frame components that form the modular frame are generally straight hollow tubes, and these hollow tubes are connected to one another via multi-armed connectors at the vertices of the individual three-dimensional structural frames.

The general footprint of the lighting system can be modularly expanded horizontally by connecting additional hollow tubes and connectors to the sides of the frame in order to form additional three-dimensional structural frames along a horizontal plane. In addition, the lighting system can also be modularly expanded vertically by connecting additional hollow tubes and connectors above or below the frame in order to form additional three-dimensional structures above or below the frame. Each adjoining pair of three-dimensional structures in the lighting system shares at least one common structural component.

Each one of the three-dimensional structures in the frame may be fitted with a light emitting panel at the bottom surface thereof in order to emit light downwardly. Advantageously, the power cable that is used to transmit electrical power to the light emitting panels can be routed through the hollow tubes and through the connectors in order to reduce clutter and improve the appearance of the lighting system.

The lighting system can either be hung from a ceiling via suspension cables or it can be fixedly mounted to the ceiling.

Exemplary embodiments of the present invention will be described more fully hereinafter with reference to the accompanying drawings. The present invention may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being connected to another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

With reference now to the drawings, and in particular to FIGS. 1 through 34, embodiments of lighting systems embodying the principles and concepts of the present invention will be described.

FIGS. 1-17 illustrate a modular lighting system according to an exemplary embodiment of the present invention.

Referring to FIG. 1, a modular lighting system includes a plurality of hollow cuboid-shaped lighting structures 100 (which can be referred to as structural frames or luminaires) modularly connected to one another at various locations and heights, a first suspension supporting structure 600 and a plurality of second suspension structures 610 connected to a ceiling or other structurally-supporting area located above the luminaires 100, a plurality of cables 200 suspending the luminaires 100 from the ceiling via the suspension structures 600 and 610 and transmitting electrical power to the luminaires 100, and a light emitting diode (LED) driver 700 configured to drive the luminaires 100 via one of the cables 200.

Referring to FIG. 1, each luminaire 100 may include a plurality of arms (or elongated structural members) 120 defining the size and shape of the luminaire (or structural frame), a light emitting panel 300 connected to one or more of the arms 120, and a plurality of connectors 400 connecting the arms 120 to one another in order to form the cube-shaped luminaires 100 illustrated in FIG. 1 Notably, each adjoining pair of luminaires 100 shares at least one common arm 120 and at least one common connector 400.

As illustrated in FIG. 1, some of the connectors 400 are also used to connect the cables 200 with the luminaires 100 in order to maintain the lighting system suspended at a desired height.

The lighting system illustrated in FIG. 1 exemplarily includes five structural frames, e.g., structural frames 100A, 100B, 100C, 100D and 100E, but the number of structural frames 100 that can be connected to one another in accordance with the present invention is not limited to five. For example, two or more structural frames can be selectively connected to one another in order to form a suspended modular lighting system as will be described in detail below.

Figure 2:
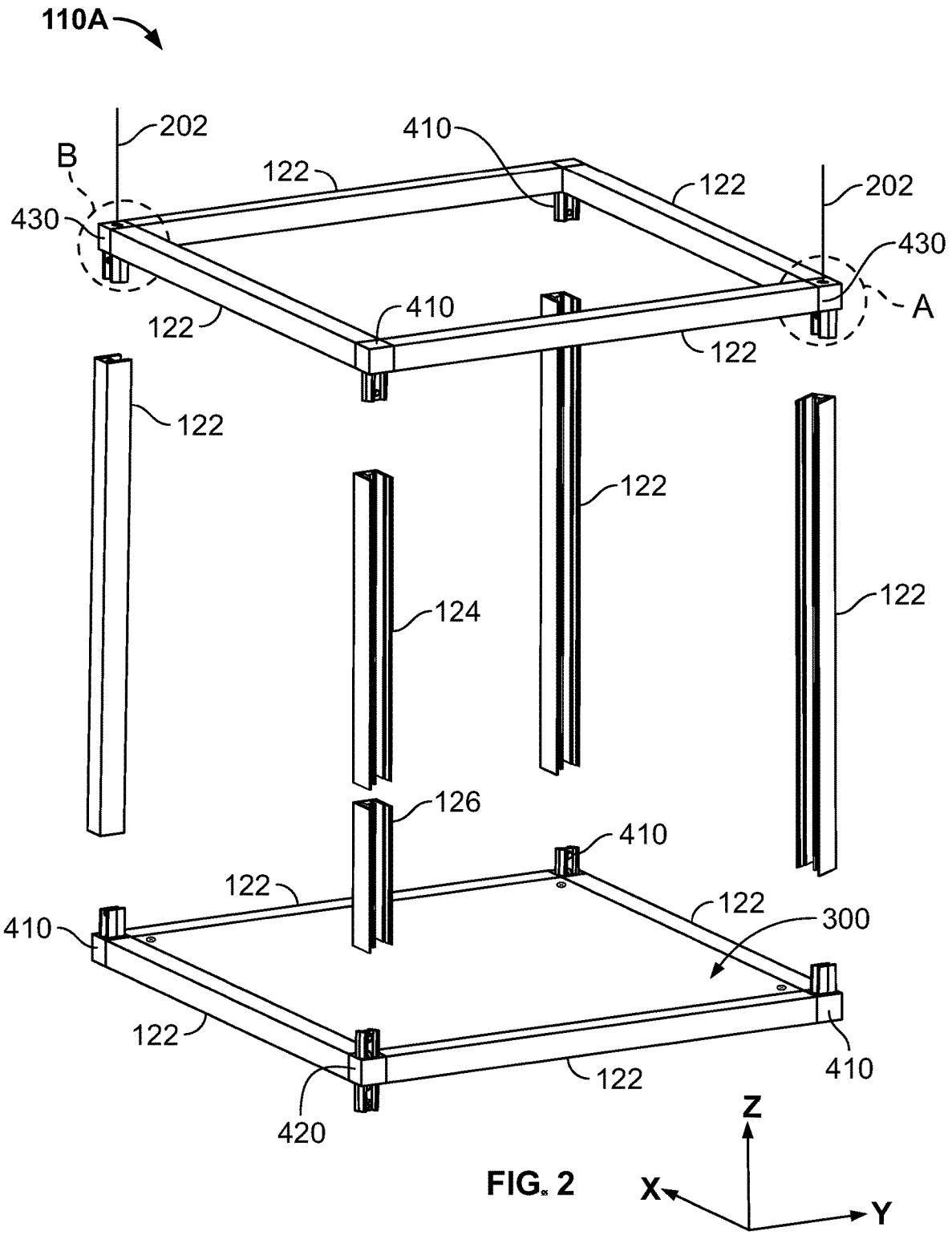
FIG. 2 is a partially exploded perspective view illustrating a structural frame included in the lighting system of FIG. 1.

FIG. 2 is a partially exploded perspective view illustrating the structural frame 100A. Referring to FIG. 2, the structural frame 100A includes a polygonal-shaped (e.g., square-shaped) light emitting panel 300 that is disposed at a bottom end of the structural frame 100A and configured to emit light downwardly in a −Z direction, a plurality of arms 122 extending along a perimeter of the panel 300 in the X and Y directions (e.g., two arms 122 extending in the X direction and two arms 122 extending in the Y direction) with one or more of said arms 122 structurally connected to the panel 300, three three-armed connectors 410 and one four-armed connector 420 connecting the four arms 122 that extend around the panel 300 to one another, one arm 122 extending vertically along the direction Z at three of the four vertical edges of the structural frame 100A, two arms (e.g., one arm 124 and one arm 126) that extend sequentially with one another in the direction Z at the fourth vertical edge of the structural frame 100A, (the arms 124 and 126 together enabling the structural frame 100B to be selectively structurally and electrically be connected to the structural frame 100A, with the arm 126 being a shared component of the structural frames 100A and 100B), four arms 122 disposed at a top end of the structural frame 100A (e.g., distal to the panel 300) with two of said four arms 122 at the top end extending in the X direction and the other two arms 122 extending in the Y direction, and a pair of three-armed connectors 410 and a pair of three-armed connectors 430 connecting the four arms 122 at the top end of the structural frame 100A to one another.

As illustrated in FIG. 2, the connectors 410 and 420 at the bottom end of the structural frame 100A and the connectors 410 and 430 at the top end of the structural frame 100A also connect the vertically-aligned arms 122, 124 and 126 to the horizontally-aligned arms 122 at the top and bottom ends of the structural frame 100A.

Therefore, as illustrated in FIGS. 1 and 2, the structural frame 100A may have a cube shape, and therefore, six square-shaped faces. The bottom square-shaped face is closed by the light emitting panel 300 while the four side faces and the top face of the structural frame 100A may be open (or hollow). However, the structural frames of the present invention are not limited to a cube shape, and may, for example, have other three-dimensional shapes. For example, each one of the structural frames 100A-100E may have a three-dimensional shape that has a plurality of triangular, rectangular, pentagonal, or other polygonal-shaped faces.

Figure 3:
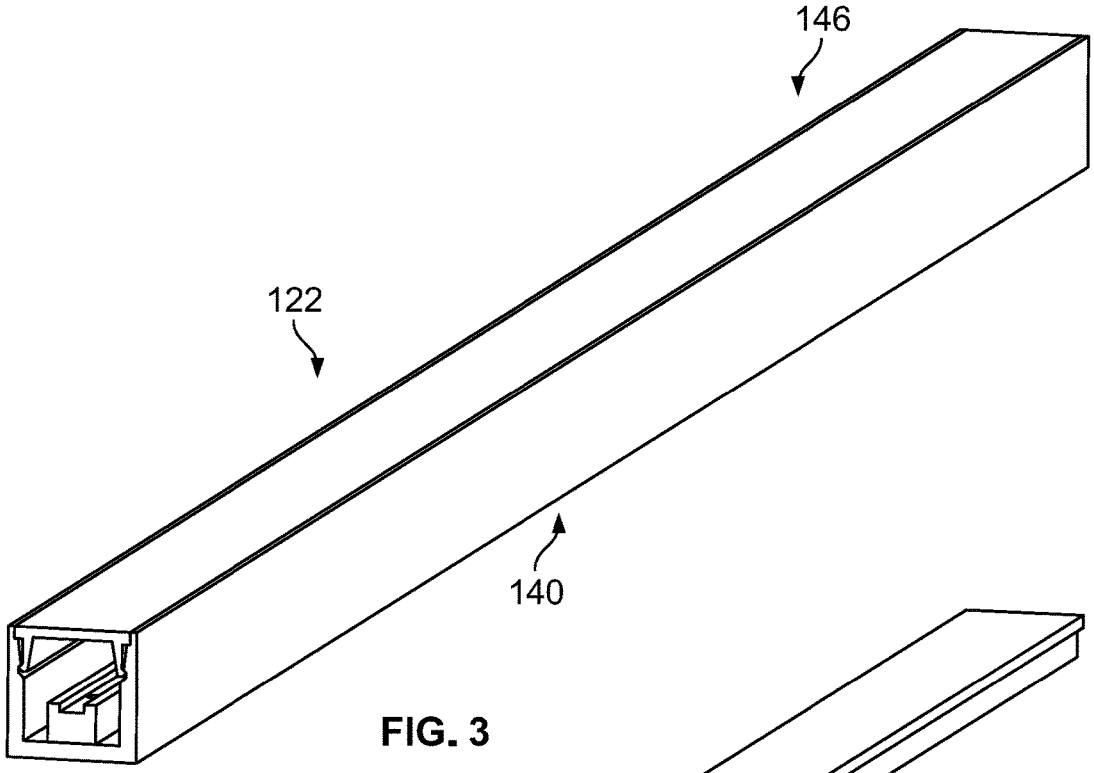
FIG. 3 is a perspective view illustrating an arm included in a structural frame of the lighting system of FIG. 1.
Figure 4:
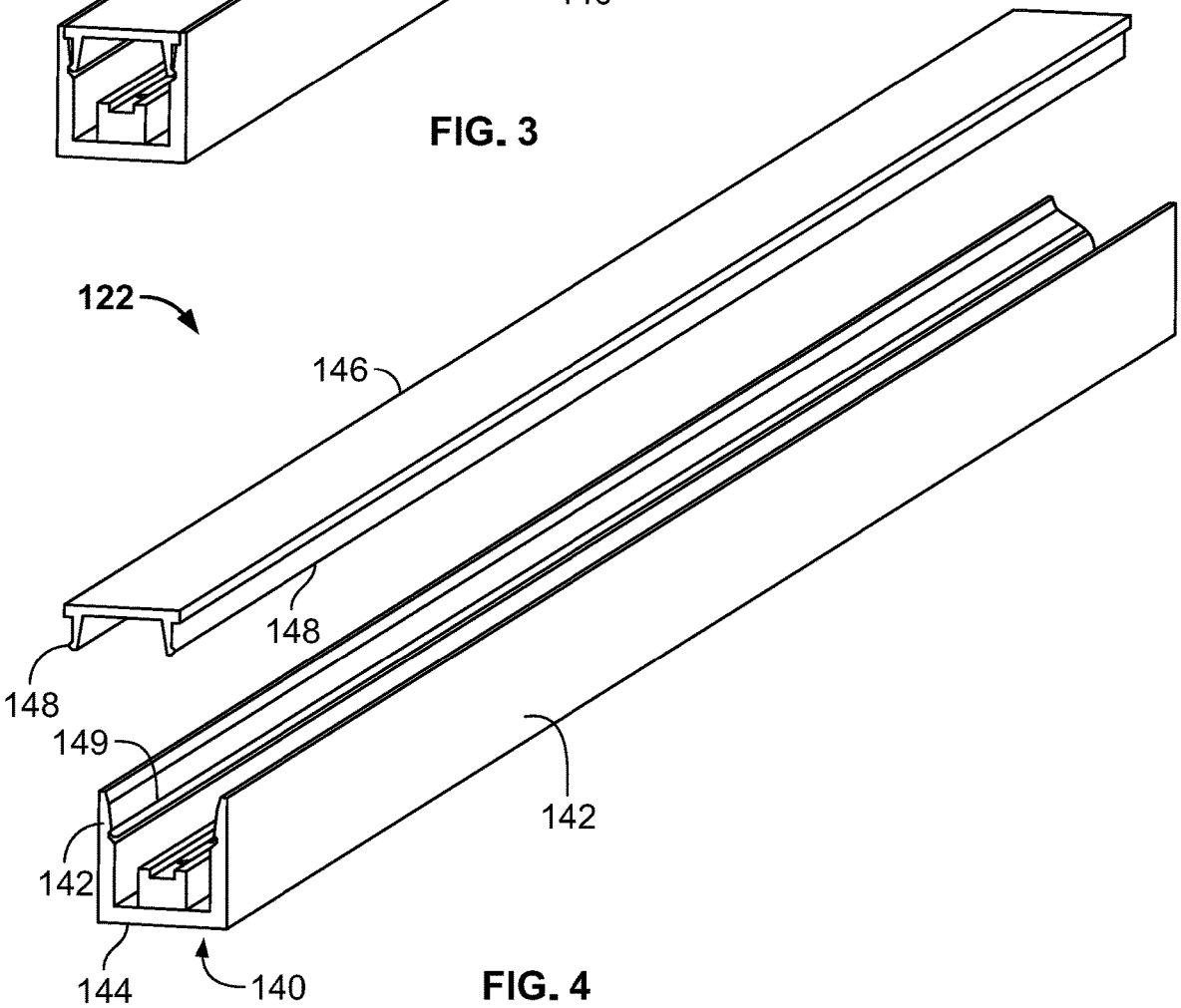
FIG. 4 is an exploded perspective view illustrating the arm of FIG. 3.

FIG. 3 is a perspective view illustrating one of the arms 122 of the structural frame 100A. FIG. 4 is an exploded perspective view illustrating the arm 122 of FIG. 3.

Referring to FIGS. 3 and 4, each arm 122 may include a first elongated component 140 and a second elongated component 146 (e.g., a cover of the first component 140). The component 140 may include a pair of sidewalls 142 spaced apart from one another and extending in a length direction of the component 140, and a sidewall 144 connecting the pair of sidewalls 142 to one another along the length of the component 140. The component 146 may be a substantially flat plate with two elongated protrusions 148 that are configured to be selectively engaged, respectively, with an elongated groove 149 extending in a length direction of each one of the sidewalls 142 of the component 140. This enables the component 146 to be selectively connected to and disconnected from the component 140. In other words, the cover 146 can be selectively snapped on and snapped off of the component 140.

Each arm 122 may have a hollow rectangular cuboid shape. As illustrated in FIG. 3, the first and second components 140 and 146 of the arm 122 define open ends in the arm 122 and a cavity that extends between the two open ends along the entire length of the arm 122. This cavity can be advantageously utilized in certain arms 122, 124 and/or 126 in order to route therethrough a power cable (e.g., cable 210), that is configured to transmit electrical power to the light emitting panel 300 of each of the structural frames 100 of the lighting system. In addition, the cavity of each arm 122 conceals the electrical power cable 210, which reduces clutter and enhances the visual appeal of a lighting system of the present invention.

The selective coupling nature of the components 140 and 146 of each arm 122 enables a lighting system of the present invention to be expeditiously assembled in the field.

The arms 124 and 126 of the structural frame 100A have a similar structural configuration as the arm 122 but are shorter in length than the arm 122. For example, in the structural frame 100A, the arm 124 is about ⅔ of the length of the structural frame 122, and the arm 126 is about ⅓ of the length of the structural frame 122. These lengths are selected in order to position a top end of the structural frame 100B (see FIG. 1) at about ⅓ of the vertical height of the structural frame 100A (in the direction Z) above the bottom end of the structural frame 100A.

Figure 5:
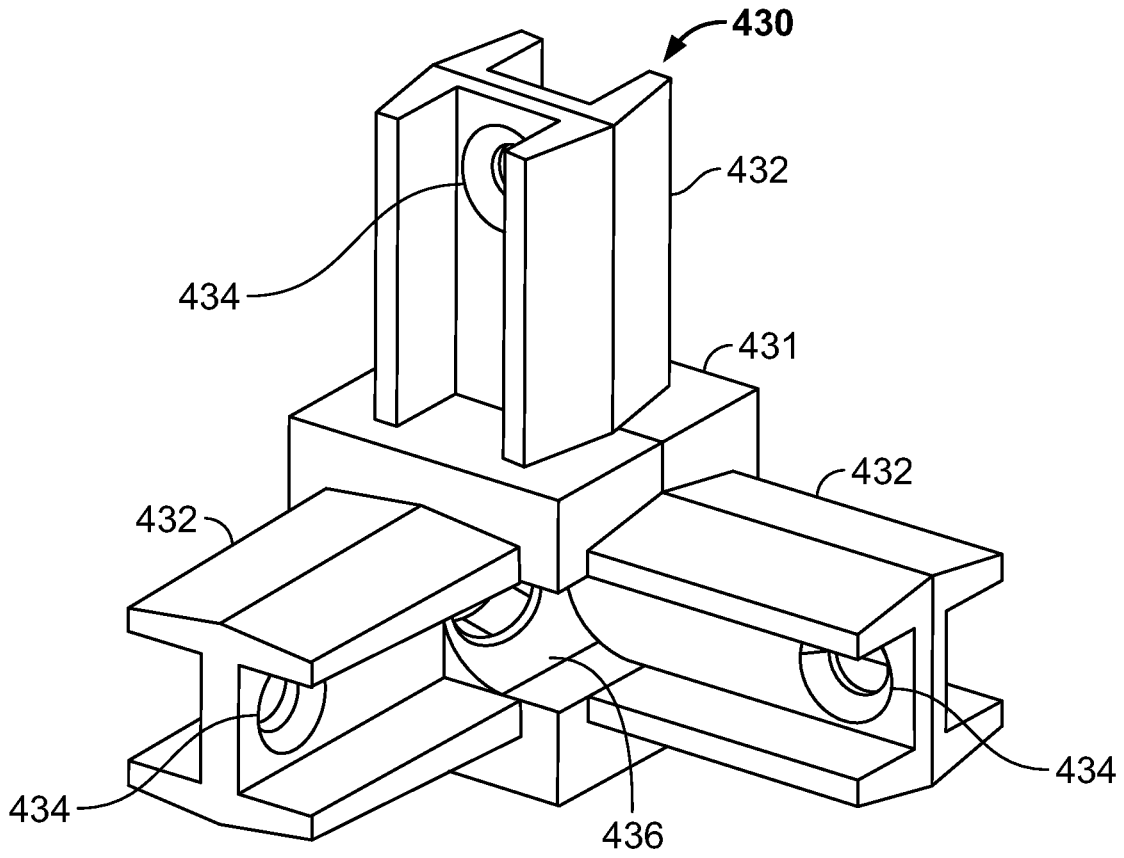
FIG. 5 is a perspective view illustrating a connector included in the lighting system of FIG. 1.
Figure 6:
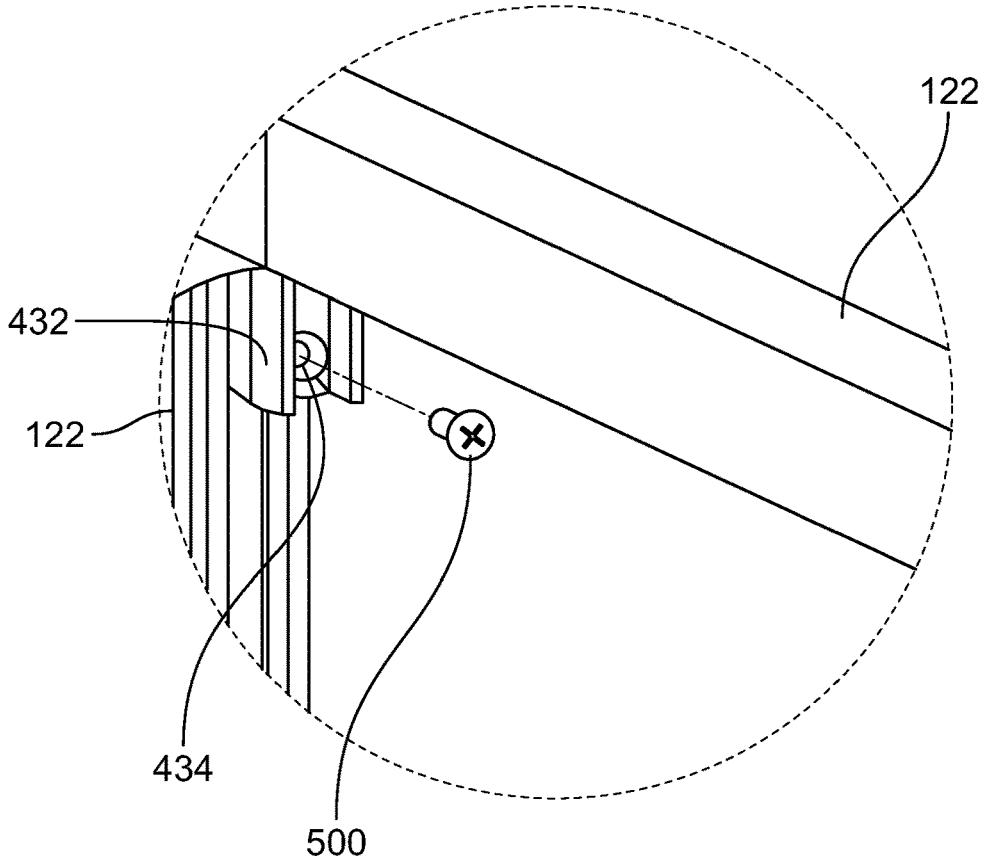
FIG. 6 is a partially exploded perspective view illustrating a region A of FIG. 2.

FIG. 5 is a perspective view illustrating one of the connectors 430 of the structural frame 100A. Referring to FIG. 5, each connector 430 may include a cube-shaped base 431 and a plurality of arms 432 (or protrusions 432) extending from the base 431 in different directions. More specifically, each connector 430 includes three arms 432 such that each connector 430 can be used to selectively connect three arms 122 to one another (or any desired combination of three arms selected from the group consisting of arms 122, 124 and 126).

As illustrated in FIG. 5, each of the arms 432 of the connector 430 has a shape resembling roughly the shape of an I-beam that is configured to be inserted inside of the cavity at an end portion of one of the arms 122, 124 and 126. Referring to FIG. 5, an opening 434 in each arm 432 enables the arm 432 to be selectively connected with an arm 122, 124 or 126 by, for example, selectively connecting a connector 500 (e.g., a set screw) to the arm 122, 124 or 126 via the opening 434 (see FIG. 6). Each end portion of each arm 122, 124 or 126, can, for example, be pre-drilled and pre-threaded to be selectively coupled with the connector 500 in order to facilitate installation of the lighting system in the field.

In one approach, the arm 432 may be shaped and sized to cause it to be frictionally engaged with a arm 122, 124 or 126 in order to facilitate the installation process of the lighting system. However, the present invention is not limited to this approach. Each one of the arms 122, 124 and 126 may be selectively connected to and disconnected from a respective arm 432 of the connector 430 in the manner described above.

As illustrated in FIG. 5, the base 431 of the connector 430 defines a vertex of the hollow cube-shaped structural frame 100A, and may have the same size and/or shape as a cross-sectional shape of each arm 122, 124 and/or 126 that it is selectively connected thereto in order to appear as a natural extension of the arms 122, 124 and/or 126.

Referring to FIG. 5, the base 431 may include a carveout (or notch) 436 disposed between two of the arms 432. The notch 436 may be utilized to pass the power cable 210 between two arms 122, 124 and/or 126 connected to the connector 430. Therefore, the connector 430 may be utilized not only to structurally connect the several arms of one or more structural frames to one another, but also for enabling the power cable 210 to extend through different arms of the same structural frame and/or through arms of neighboring structural frames.

The base 431 may also include a vertically-extending through opening (vertically with respect to the orientation of FIG. 5, the vertical through opening is not shown in FIG. 5) that is connected to the notch 436. This vertical through opening can be used to route a power cable that extends downwardly in the vertical direction −Z from the vertically-aligned arm 432 of FIG. 5 to pass through the base 431 and to be routed via either one of the horizontally-extending arms 432, as needed.

Figure 7:
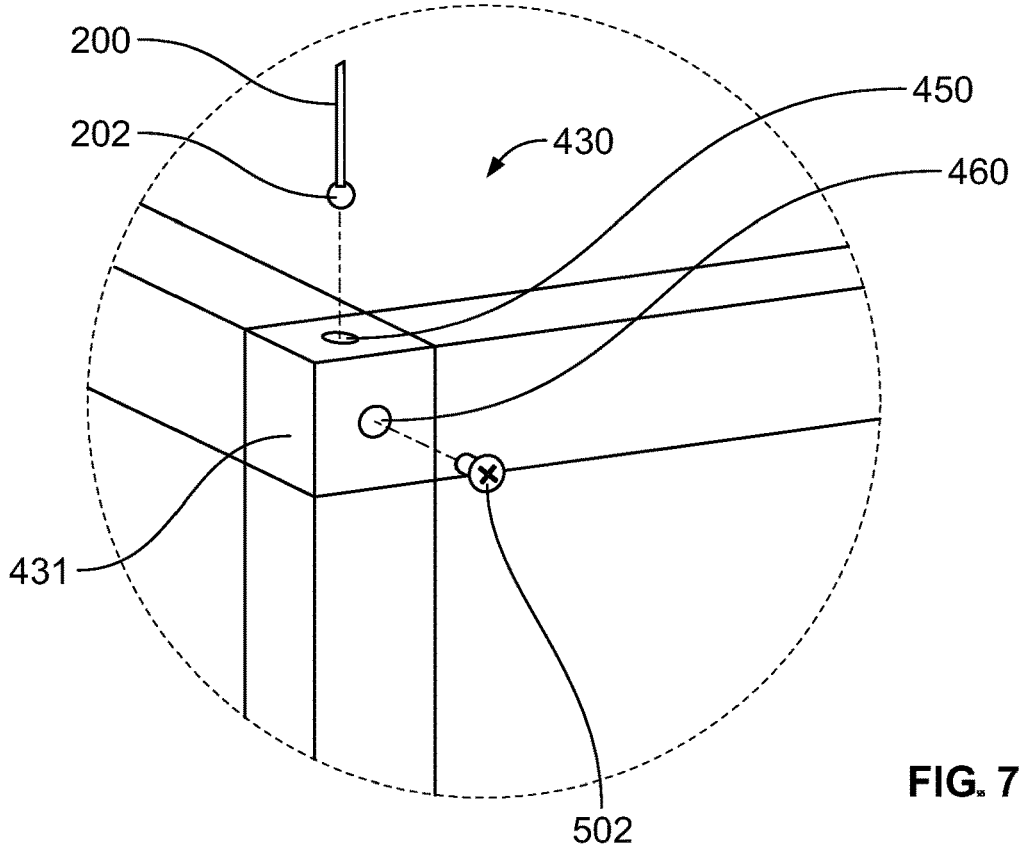
FIG. 7 is a partially exploded perspective view illustrating a region B of FIG. 2.

Referring to FIG. 7, the connector 430 may also be used for suspending the structural frame 100A from the ceiling via one of the cables 200. For example, the cable 200 may have a knot, ball, or enlargement formed at an end 202 thereof. The enlarged end 202 of the cable 200 is configured to be inserted in a first opening 450 that extends into the base 431 from a first side surface of the base 431. The base 431 may also include a second opening 460 extending into the base 431 into the base 431 from a second side surface of the base 431. The first and second openings 450 and 460 may intersect one another inside of the base 431.

After the end 202 of the cable 200 is inserted into the opening 450, and a fastener 502 (e.g., a set screw) may be inserted via the opening 460 deep enough into the base 431 to make contact with the enlarged end 202 of the cable 200 inside of the base 431. The fastener 502 may be selectively (e.g., threadably) connected to the base 431 in order to prevent the enlarged end 202 of the cable 200 from being disconnected from the base 410. Therefore, the fastener 502 may be used to selectively connect the cable 200 to a vertex of the structural frame 100A.

Figure 8:
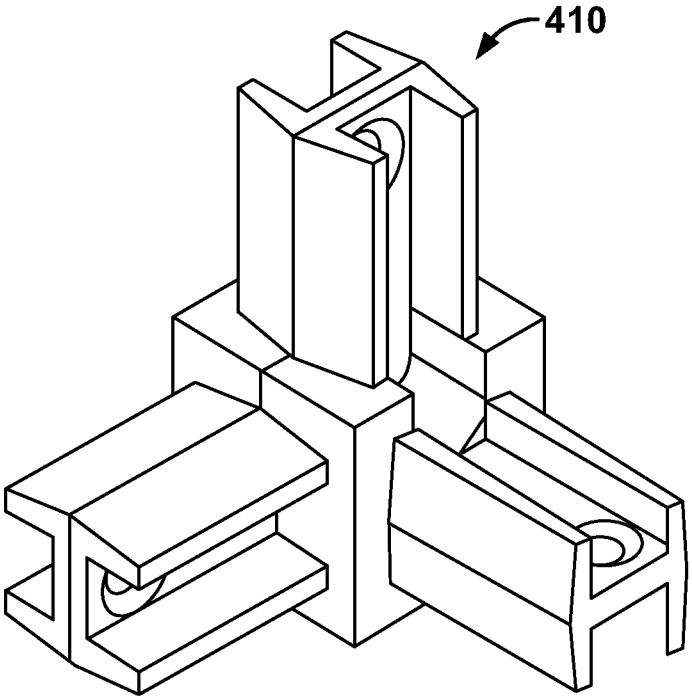
FIG. 8 is a perspective view illustrating a connector included in the lighting system of FIG. 1.

FIG. 8 is a perspective view illustrating the connector 410. The connector 410 may be similar to connector 430, except that connector 410 may omit the two openings 450 and 460 that the connector 430 includes because the connector 410 need not be tied to a suspension cable 200. In addition, the I-beam like arms of the connector 410 may have a different alignment than their counterparts in the connector 430, as can be seen by comparing the connectors 430 and 410 in FIGS. 5 and 8.

Figure 9:
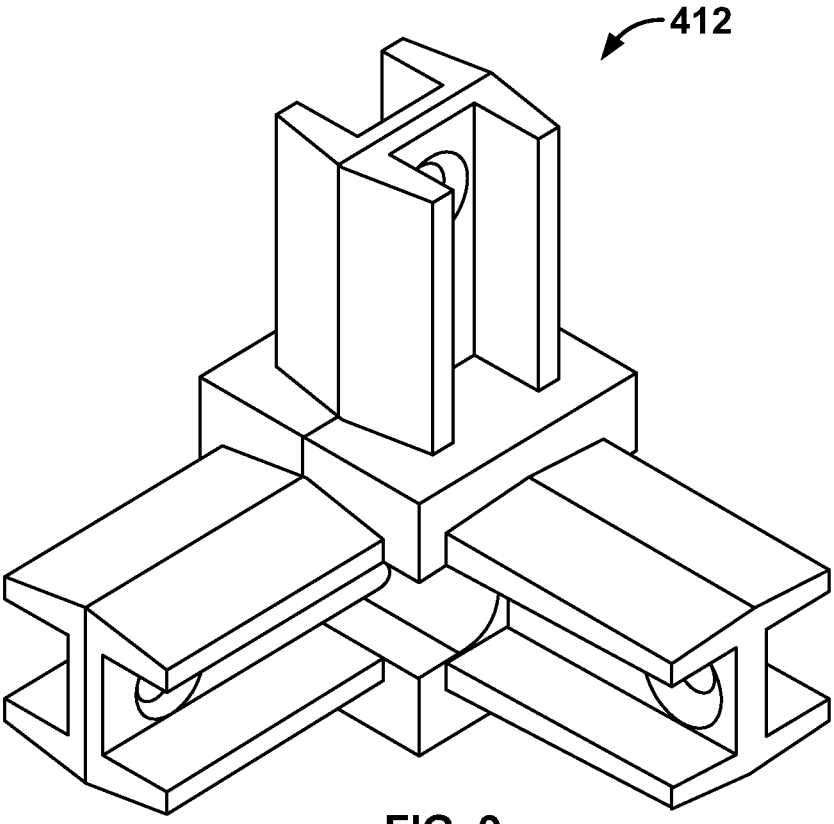
FIG. 9 is a perspective view illustrating a connector included in the lighting system of FIG. 1.

FIG. 9 is a perspective view illustrating a connector 412. The connector 412 may be similar to connector 410 in that it need not be used for suspending the structural frame 100A via a suspension cable 200.

Figure 12:
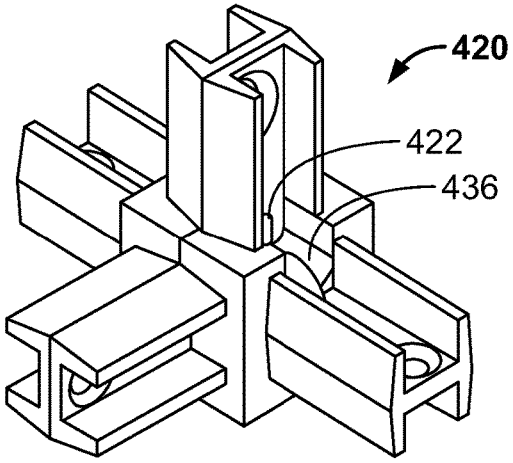
FIG. 12 is a perspective view illustrating a connector included in the lighting system of FIG. 1.

Referring to FIGS. 2 and 12, the connector 420 may be similar to the connector 430 except that the connector 420 includes four arms, for example, two arms arranged in-line with one another and two other arms, respectively, extending at a 90 degree angle relative to the in-line arms and at 90 degrees relative to one another. Such a connector enables four arms 122, 124 and/or 126 to be selectively connected to the connector 420. The connector 420 may include an opening 422 in its base (see FIG. 12) in order to enable a power cable (e.g., the cable 210) to pass through the base in the X direction, and a notch 436 between the arm extending in the Z direction and the arm extending in the −X direction. Therefore, a power cable can be routed to pass through the two arms that lie in the direction X and/or through the arm that extends in the direction Z.

Figure 13:
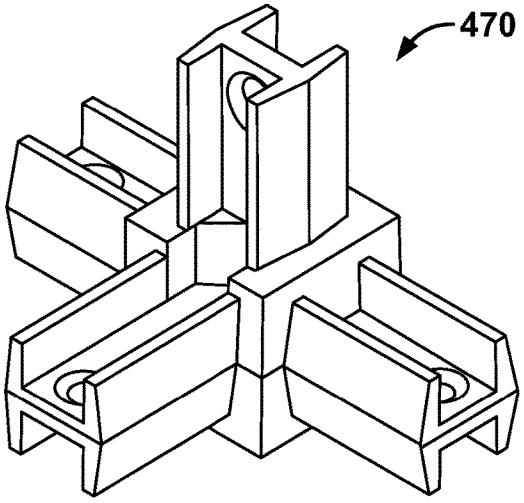
FIG. 13 is a perspective view illustrating a connector included in the lighting system of FIG. 1.
Figure 14A:
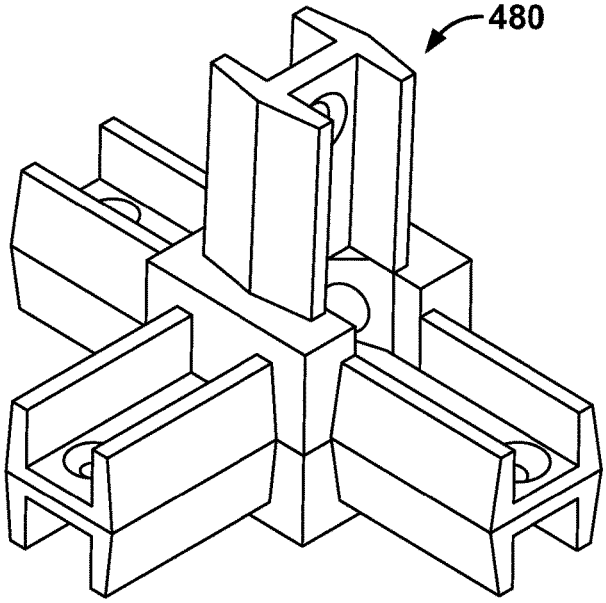
FIG. 14A is a perspective view illustrating a connector included in the lighting system of FIG. 1.

FIG. 13 illustrates a connector 470 with four arms, and FIG. 14A illustrates a connector 480 with four arms. The connectors 470 and 480 may be similar to the connector 420.

Figure 10:
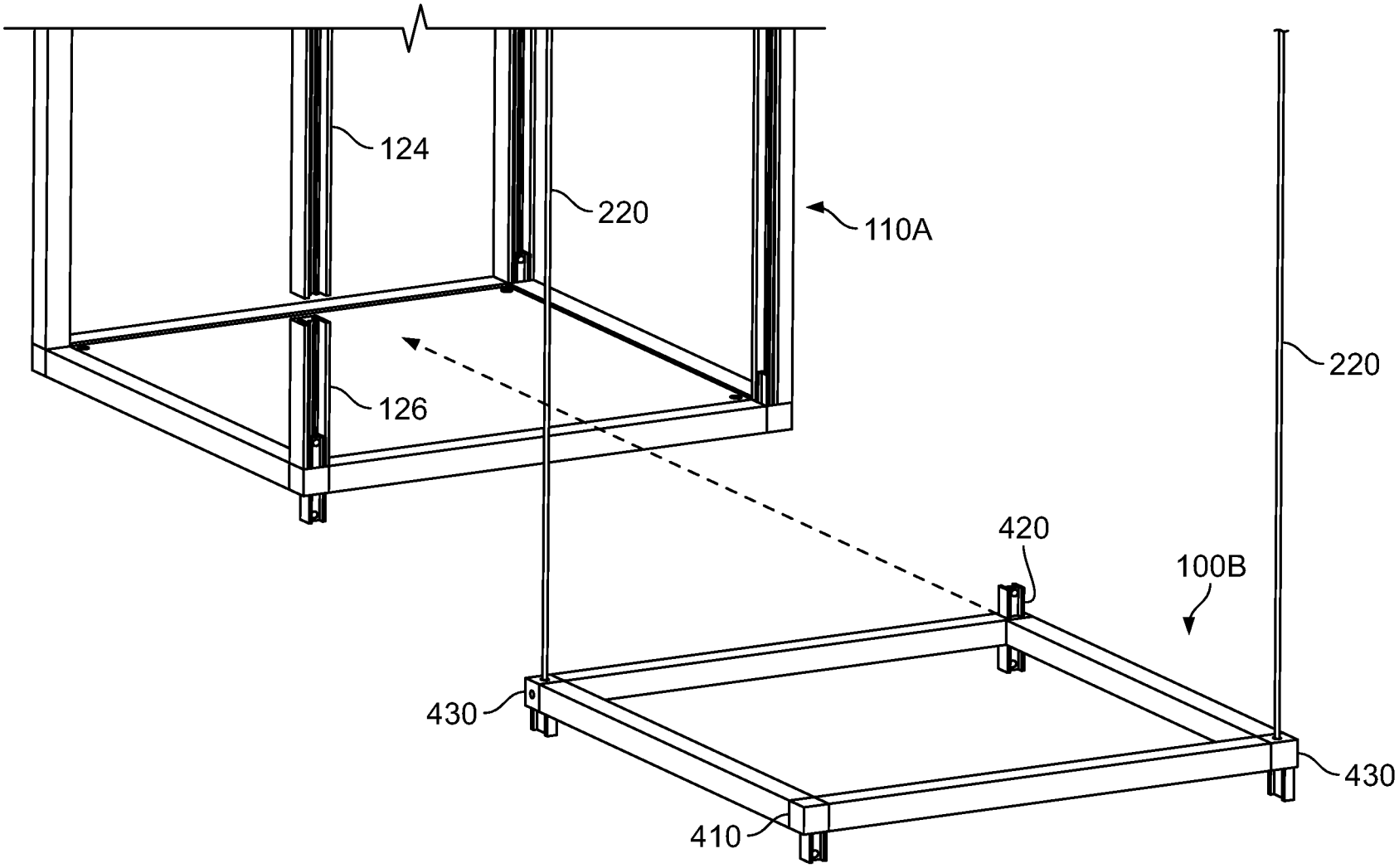
FIG. 10 is a partially exploded perspective view illustrating a portion of the lighting system of FIG. 1.
Figure 11:
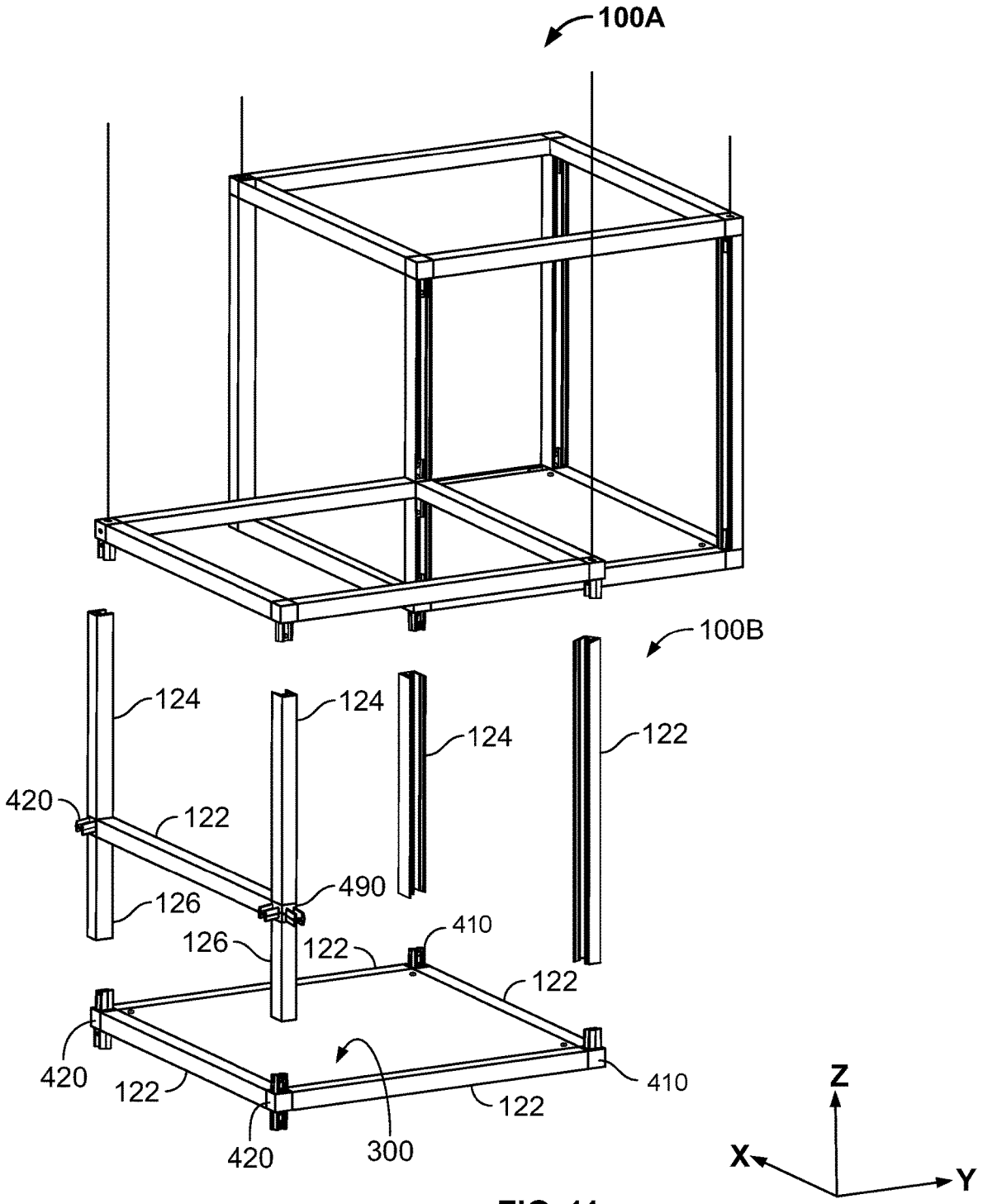
FIG. 11 is a partially exploded perspective view illustrating a portion of the lighting system of FIG. 1.

FIG. 10 is a perspective view illustrating a top end portion of the structural frame 100B in the process of being selectively connected to the edge of the structural frame 100A that is formed of the arms 124 and 126. FIG. 11 is a perspective view illustrating the top end of the structural frame 100B selectively connected to the structural frame 100A and the remainder of the structural frame 100B in a partially exploded state.

Referring to FIG. 11, the structural frame 100B includes a light emitting panel 300 that is disposed at a bottom end of the structural frame 100B and configured to emit light downwardly in a −Z direction, a plurality of arms 122 extending along a perimeter of the panel 300 in the X and Y directions (e.g., two arms 122 extending in the X direction and two arms 122 extending in the Y direction) with one or more of said arms 122 structurally connected to the panel 300, two three-armed connectors 410 and two four-armed connector 420 connecting the four arms 122 that extend around the panel 300 to one another, one arm 122, three arms 124 and two arms 126 that extend vertically in the direction Z at the four vertical edges of the structural frame 100B, a four-armed connector 420 connecting one of said vertical arms 124 with one of said vertical arms 126, a five-armed connector 490 (see FIG. 14B) connecting the other vertical arm 124 with the other vertical arm 126, a arm 122 extending in the direction X and being connected to the connectors 420 and 490 that connect the vertical pairs of arms 124 and 126 to one another, four arms 122 at a top end of the structural frame 110B (two in the direction X and two in the direction Y, see FIG. 10), and four connectors connecting the top four arms 122 at the top end of the structural frame 100B to one another (see FIG. 10).

With reference to FIG. 10, the four connectors at the top end of the structural frame 100B include a pair of hanging connectors 430, a connector 410, and a connector 420. The pair of hanging connectors 430 are respectively connected to cables 220 from above and to the arms 122 and 124 from below. The connector 410 at the end of the structural frame 100B is connected to the arm 124 below. The connector 420 at the top end of the structural frame 100B is connected to the vertically-oriented arms 124 and 124 of the structural frame 100.

Therefore, the connector 420 disposed at the top end of the structural frame 100B is also a structural component of the structural frame 100A because it structurally connects the vertical arms 124 and 126 of the structural frame 100A to one another. In other words, the connector 420 at the top end of the structural frame 100B is a shared component of the structural frames 100A and 100B.

In addition, the vertical arm 126 of the structural frame 100A is also a structural component of the structural frame 100B because said vertical arm 126 together with the vertical arm 124 below it forms a full-length vertical edge of the structural frame 100B. Therefore, the structural frames 100A and 100B share an edge together, and the shared edge comprises about ⅓ of the vertical height of the structural frames 100A and 100B.

Figure 14B:
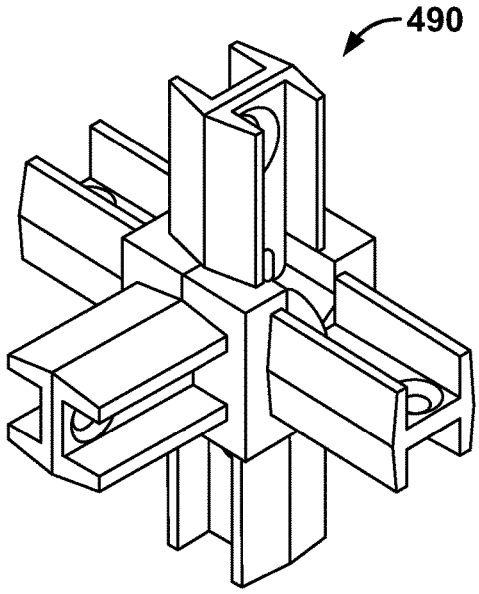
FIG. 14B is a perspective view illustrating a connector included in the lighting system of FIG. 1.
Figure 14B:
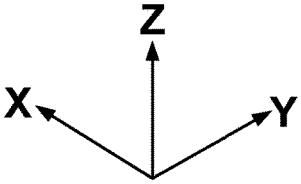

Referring to FIG. 14B, the five-armed connector 490 of the structural frame 100B includes a pair of arms extending in the direction X, a pair of arms extending in the direction Z, and one arm extending in the direction Y. The five-armed connector 490 may include one or more through openings and/or notches in order to enable a power cable to extend from one of the five arms of the connector 490 to any one of the other four arms in order to route a power cable as needed through the connector 490.

Referring to FIG. 1, the structural frames 100C and 100E may each include a light emitting panel 300, a plurality of arms 122, 124 and 126, and a plurality of three, four and five-arm connectors 410, 412, 430, 420, 470 and 480 in order to form the structural arrangement thereof illustrated in FIG. 1.

The structural frames 100A, 100B, 100C and 100E may be referred to as luminaires because they include a respective light emitting panel 300. The structure 100D is not considered a luminaire because it omits a light emitting panel. In other words, the structure 100D is a structural component of the lighting system of FIG. 1 and may even be used to pass the electrical cable 210 therethrough, but is not used for emitting light.

The structure 100D may also include a plurality of arms 122, 124 and 126, and a plurality of three, four and five arm-connectors 410, 412, 430, 420, 470 and 480 as illustrated in FIG. 1.

The light emitting panel 300 of each luminaire 100A, 100B, 100C and 100E may be flat and may include at least one light emitting diode as a light source.

Referring to FIG. 1, the LED driver 700 is connected to a cable 230 that inputs electrical power to the LED driver 700 from a power source (e.g., the building electrical line). The LED driver 700 is configured to output electrical power to the luminaires 100A, 100B, 100C and 100E via an electrical cable 210 (of the plurality of cables 200) in order to drive the luminaires 100A, 100B, 100C and 100E to emit light.

As illustrated in FIG. 1, the electrical cable 210 may be fixedly connected to a ceiling supporting structure 600, and may extend vertically down to the only three-armed connector 430 of luminaire 100C, and may be fixedly connected with said connector 430. Therefore, the electrical cable 210 may be used a suspension cable for suspending the lighting structure of FIG. 1 from a ceiling. Importantly, cable 210 includes at least two power wires transmitting positive (+) and negative (−) voltage for driving the luminaires 100A, 100B, 100C and 100E.

The cable 210 may be connected to an array of other cables inside of the lighting system in order to transmit driving power to the luminaires 100A, 100B, 100C and 100E. The internal cables may extend through the arms 122, 124 and 126, through the connectors 410, 412, 430, 420, 470 and 480, and through the light emitting panels 300 of the lighting system of FIG. 1.

Each light emitting panel 300 may have an internal cable configured to be electrically connected to the power cable 210 in order to power the LEDs included in the panel, and to output the electrical power of the cable 210 to other light emitting panels 300 in the lighting system.

Figure 15:
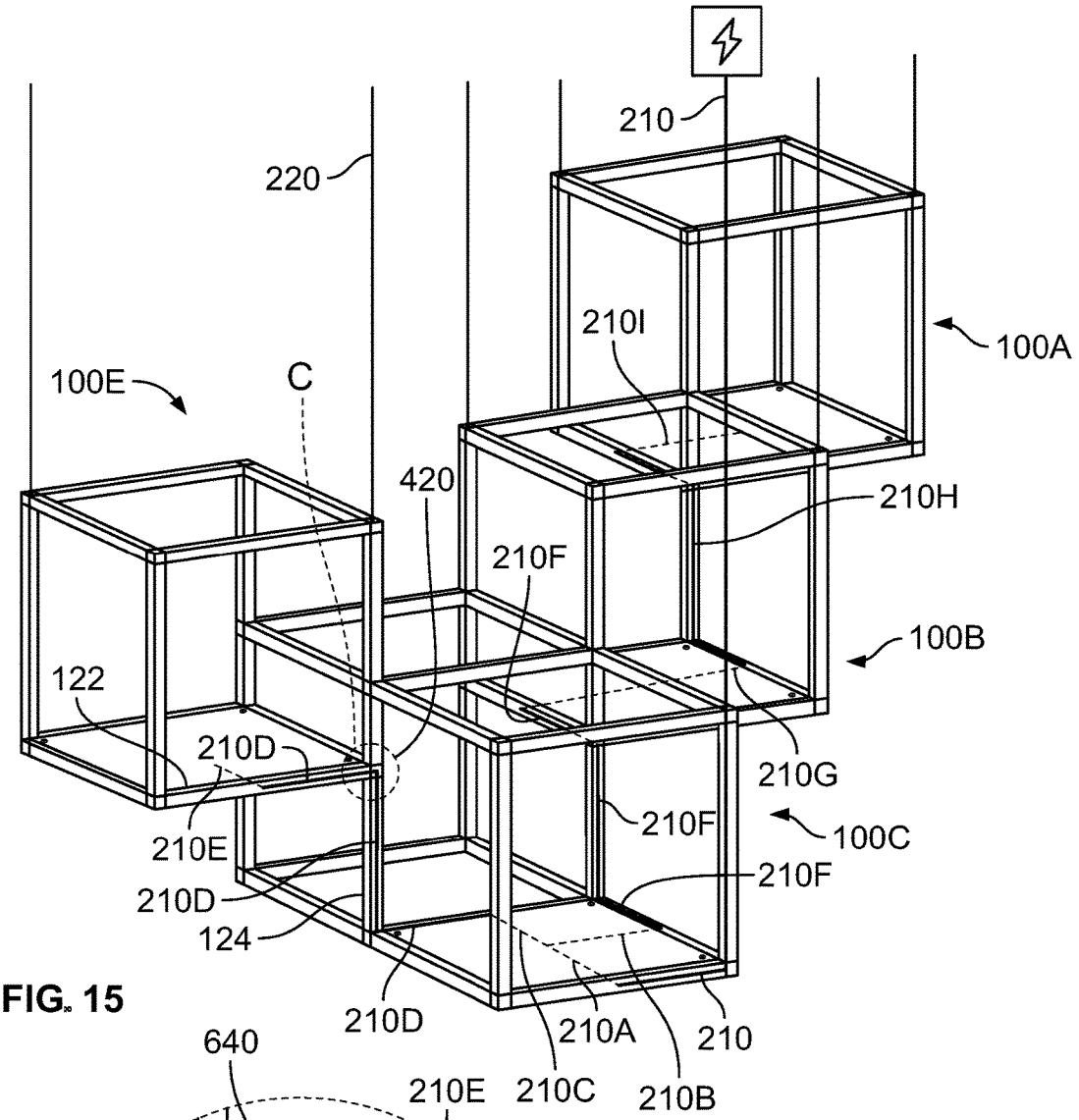
FIG. 15 is a perspective view illustrating a wiring diagram of the lighting system of FIG. 1.
Figure 16:
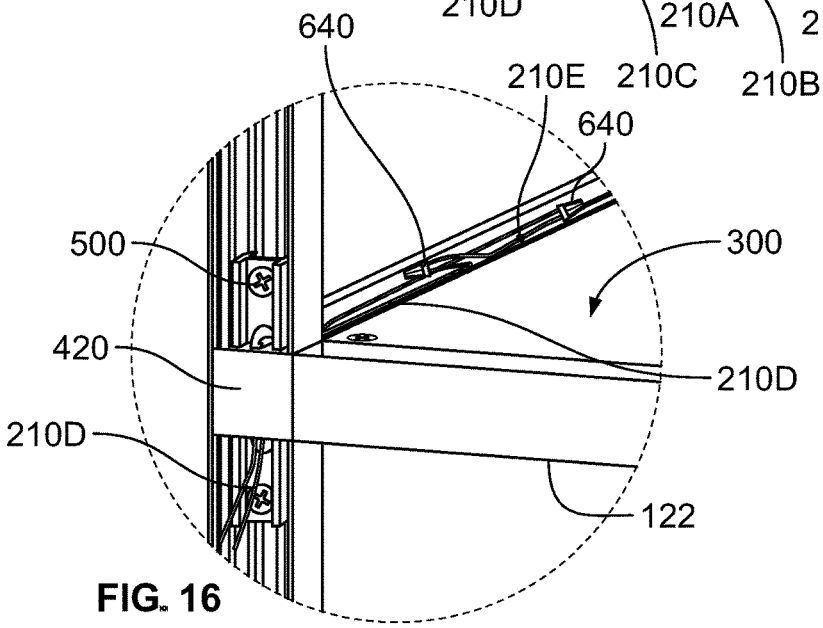
FIG. 16 is a perspective view illustrating a region C of FIG. 15.
Figure 17:
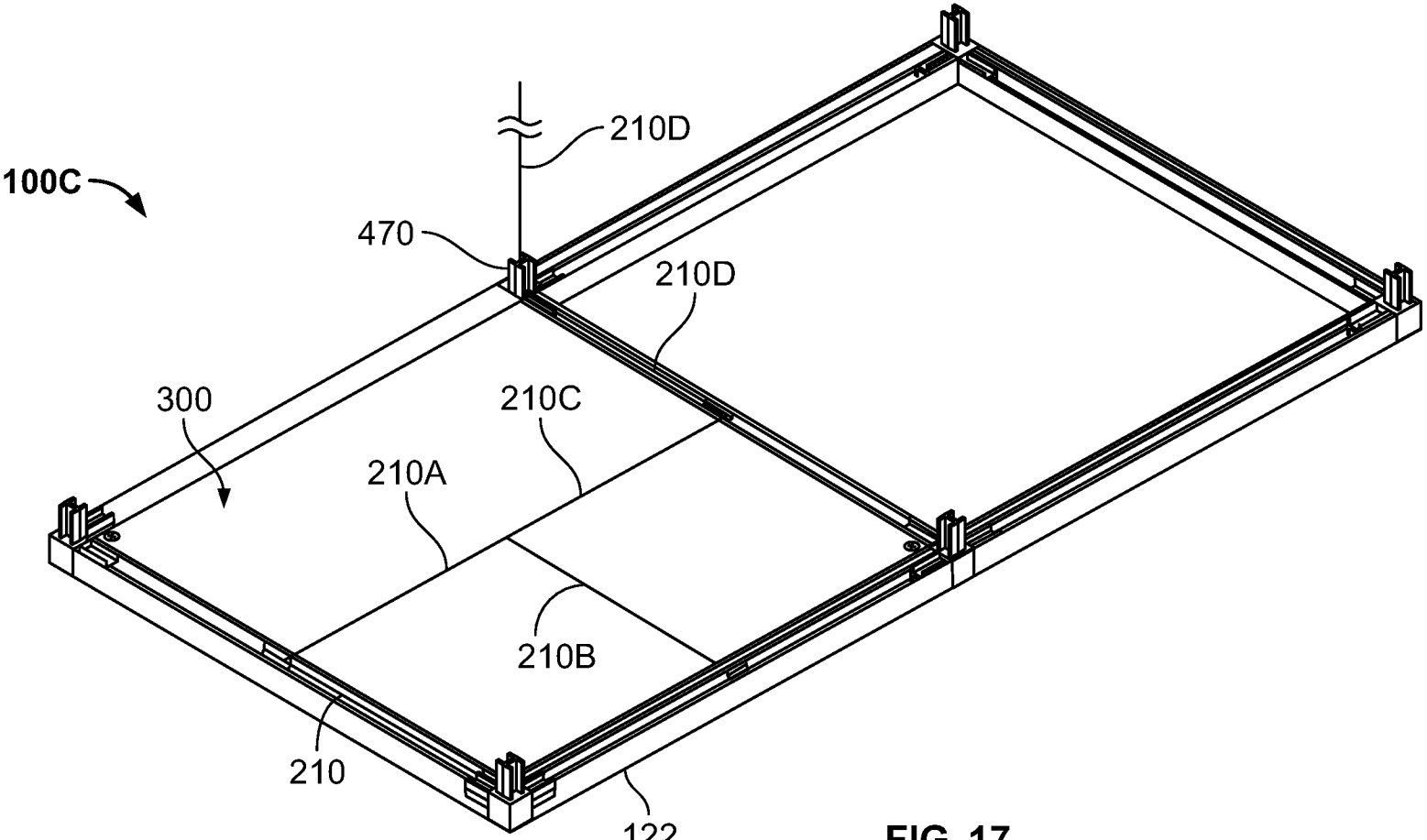
FIG. 17 is a perspective view illustrating an upper part of two bottom regions of the structural frame of the lighting system of FIG. 1.

FIGS. 15-17 illustrate the internal wiring diagram of the lighting system of FIG. 1. Referring to FIG. 15, the power cable 210 enters the luminaire 100C and is connected to a cable 210A that is internal to the light emitting panel 300 of the luminaire 300 (see FIG. 17). As illustrated in FIG. 17, the cable 210A is connected in parallel to cable 210B and cable 210C inside of the panel 300, each of which extending out of different edges of the light emitting panel 300 (and pass through their respective arms 122 of the luminaire 100C through a respective opening on a sidewall of the 142 of the adjacent arm 122.

The connection between the cable 210 and cable 210A may be made, for example, by utilizing wire nuts inside of the arm 122 that the cable 210A passes through. Referring to FIGS. 15 and 17, cable 210D may be electrically connected to the cable 210C inside of the arm 122, and may continue through the arm 122 and through the connector 470 (see FIG. 17) at the bottom of the luminaire 100C, through a vertical arm 124 at a left side of the luminaire 100C, through a connector 420 in the luminaire 100E (see FIG. 15), and through a arm 122 at the bottom of the luminaire 100E (see FIG. 15) in order to be selectively connected to a cable 210E of the light emitting panel 300 of the luminaire 100E. Therefore, the luminaire 100E may be used to emit light according to controls of the LED driver 700.

The cable 210D passing through the connector 420 is illustrated more clearly in FIG. 16. As exemplarily illustrated in FIG. 16, the cable 210D may be connected to the cable 210E via wire nuts. Other wire connection mechanisms can be utilized to connect the cables to one another.

As illustrated in FIG. 15, the cable 210B may be electrically connected to a cable 210F, which, in turn, is connected to a cable 210G in order to power the light emitting panel 300 of the luminaire 100C. In addition, cable 210H may be electrically connected to a cable 210I of the emitting panel 300 of the luminaire 100A in order to power the emitting panel 300 of the luminaire 100A.

Therefore, a single cable 210 can be advantageously utilized to power all of the luminaires 100A, 100B, 100C and 100E via power transmitted from the LED driver 700 through wiring that is internal to the structures 100A-100E.

All of the other cables 220 of the lighting system are utilized solely for suspending the lighting structure that comprises the luminaires 100A, 100B, 100C and 100E and the structure 100D from the ceiling via the suspension structures 610. As illustrated in FIG. 1, each suspension structure 160 may include a through opening which the cable 220 passes through such that the length of the cable 220 can be varied as desired prior to clamping the cable 220 to the structure 160. This configuration is advantageous because it enables the suspension height of the lighting system to be altered as needed during the installation phase in order to set the lighting system at a desired height.

The luminaires 100A and 100B are described as sharing a portion of a vertical edge with one another. Therefore, they are arranged edge-to-edge. As illustrated in FIG. 1, the luminaires 100B and 100E are arranged face-to-face with the structure 100D because the structure 100D shares a portion of one of its side surfaces with the luminaire 100B and a portion of another side surface with the luminaire 100E. However, as illustrated in FIG. 1, the luminaire 100C is arranged in an edge-to-edge configuration with respect to the luminaires 100B and 100E. Therefore, in an exemplary embodiment of the present invention, a pair of neighboring structural frames may be adjoined to one another via a shared edge or a shared side, as needed, in order to create a modular light-panel-carrying-structure that extends horizontally above a space to be illuminated, and vertically, as needed.

While the luminaires 100A, 100B, 100C and 100E and the structure 100D are illustrated as having hollow cube shapes, the present invention is not limited to this configuration. These luminaires and/or structure may each have other geometrical shapes, for example, a hollow triangular prism shape, a hollow square prism shape, a hollow rectangular prism shape, a hollow hexagonal prism shape, etc.

As illustrated in the description above, a lighting system of the present invention may include a structure that does not contain a light emitting panel 300. However, this configuration is merely exemplary, and each one of the hollow cube shaped structural components (or structural components of other shapes) of the present invention may be fitted with a light emitting panel. Alternatively, two or more of such structures might not be fitted with a light emitting panel, depending on lighting requirements and architectural requirements.

The disclosure above describes a lighting system that includes five structural components 100A, 100B, 100C, 100D and 100E. However, the number of structural components that can be joined together to form a lighting system of the present invention may vary as needed, and may be, for example, less than five or greater than five. In addition, as can be gathered from the description above, the spatial arrangement of the structural components can be set as needed, whether by placing two structure components side to side, edge to edge, at the same elevation, at different elevations, or a combination of these parameters.

Therefore, the arms of different lengths and connectors of different arms/configurations as described above can be selectively coupled with one another (in conjunction with one or more light emitting panels) to form a three-dimensional lighting system that is strong, graceful and fulfills the illumination needs of a particular space.

Advantageously, the structure of the lighting system can also be used to conceal the wiring that transmits electrical power to the lighting panels of the system.

As can be understood with respect to the disclosure above, a lighting system of the present invention can also be easily modified after it has been built and hung due to its modular nature. For example, additional luminaires can be added to a lighting system that has already been constructed by partially deconstructing an existing luminaire that will be located adjacent to a new luminaire that will be added, and replacing one or more connector(s) and/or arm(s) of the deconstructed luminaire(s) with different arm(s) and/or connector(s) to allow for the addition of a new luminaire, consistent with the disclosure of this specification.

This can be used, for example, to add a new luminaire above, below or at the same elevation as an existing luminaire, and to connect the new and existing luminaires face to face or edge to edge with one another. Depending on the configuration, each added luminaire may also need to supported by a suspension cable, as described above with respect to the suspension cables 200.

In addition, a luminaire can also be removed from a lighting system during or after the construction phase, as needed. Whether adding or removing a luminaire from a lighting system of the present invention, the power cable that extends through the arms of the system can be lengthened or shortened, as the case may be, in accordance with the teachings of this disclosure, in order to transmit electricity to a newly added luminaire or to remove excess length when removing a luminaire.

The lighting system described above includes LED panels 300 and an LED driver 700. However, the present invention is not limited to this disclosure, and a lighting system of the present invention can also include other types of light sources, for example, incandescent light sources, fluorescent light sources, etc., or a combination thereof.

The lengths of the arms that make up the structural frames 100A-100E are exemplarily described as having lengths in ⅓ intervals, but the present invention is not limited to this configuration. For example, the arms that are less than full length may have a length that is varied as needed. The arms that are less than full length may be, for example, ¼, ½ and ¾ of the length of the full-length arm, or at other proportions/lengths, as needed.

In addition, with the exception of shared arms, the arms of one structural frame need not necessarily be the same length or the have the same proportions as the arms of an adjoining structural frame.

FIGS. 18-21 illustrate a modular lighting system according to another exemplary embodiment of the present invention.

Figure 18:
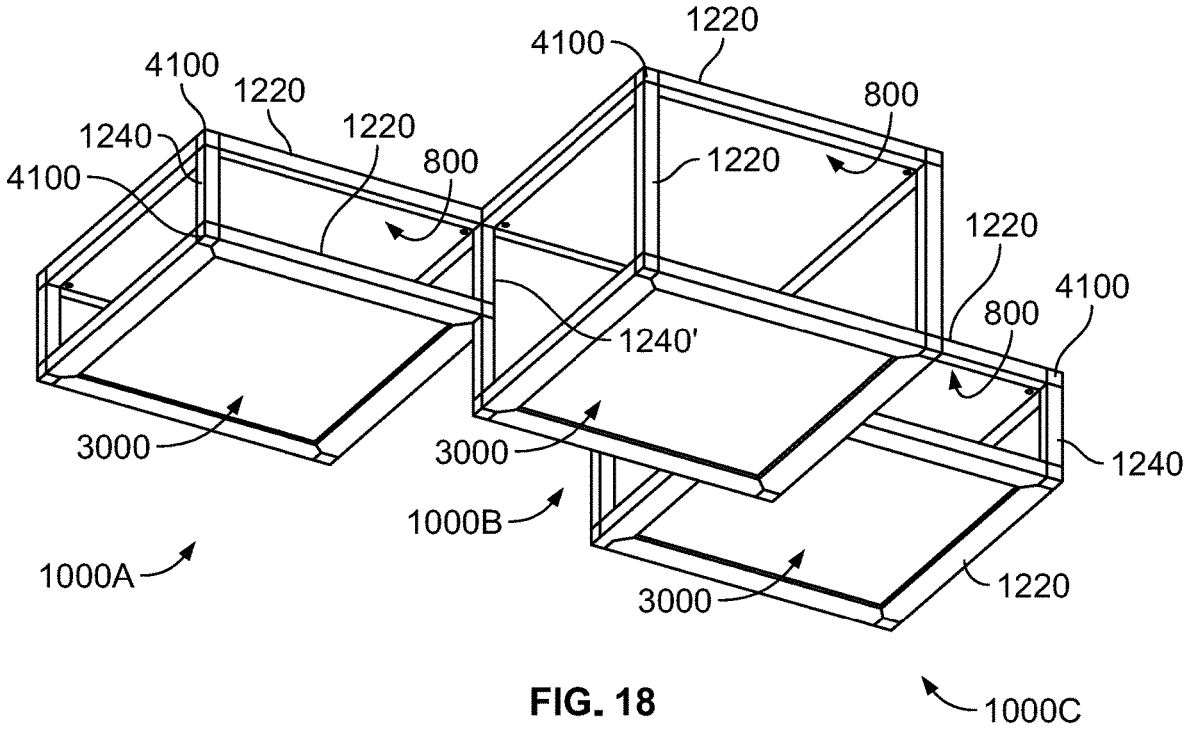
FIG. 18 is a perspective view illustrating a modular lighting system according to an exemplary embodiment of the present disclosure.

The modular lighting system of FIGS. 18 is configured to be attached to a ceiling or other supporting structure. Referring to FIG. 18, the modular lighting system includes a plurality of structural frames 1000A, 1000B and 1000C adjoined to one another via common (or shared) arms), a light emitting panel 3000 disposed at a bottom end of each one of the frames 1000A-1000C, and power cable 2100 (see FIG. 21) transmitting driving power to the light emitting panels 3000 of the frames 1000A, 1000B and 1000C.

As illustrated in FIG. 18, the structural frames 1000A, 1000B and 1000C may each include a plurality of arms of various lengths (e.g., the arms 1220 and 1240), a plurality of three and four-armed connectors (e.g., the connectors 4100) and at least one arm 1240' shared between the structural frames 1000A, 1000B. The arms and connectors of the lighting system of FIG. 18 may be assumed to be similar to or the same as other arms and/or components described elsewhere in this specification. Therefore, they need not be described again to avoid duplicity.

As illustrated in FIG. 18, a top end of each one of the structural frames 1000A, 1000B and 1000C may include a plate 8000 connected to the arms 1220 of the three-armed connectors 4100. The plate 8000 may be used to selectively attach each respective structural frame 1000A, 1000B and 1000C to the ceiling.

Figure 19:
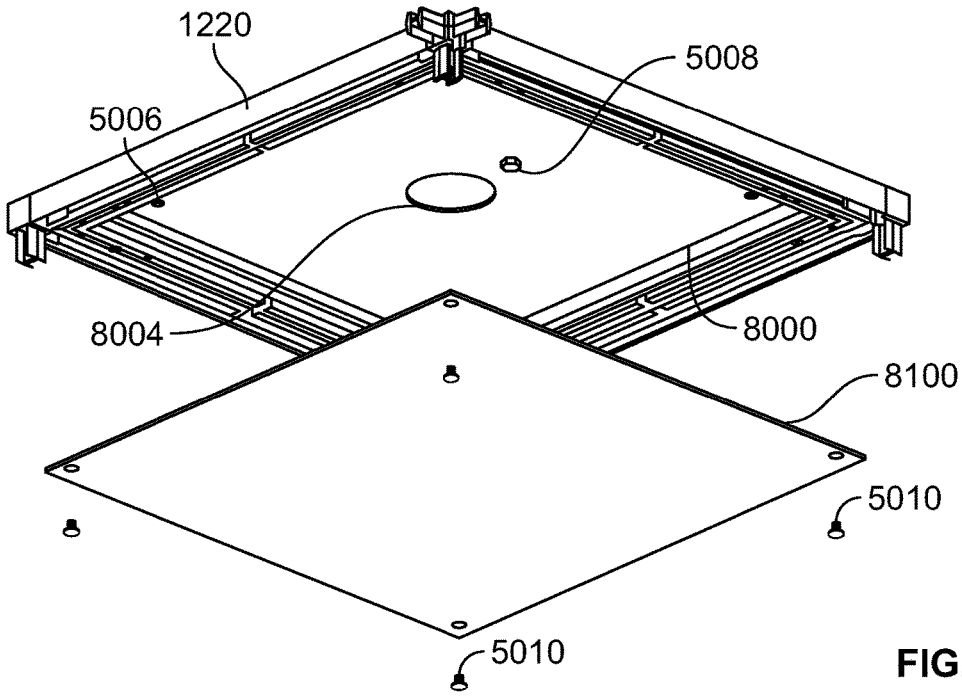
FIG. 19 is a perspective view illustrating an upper part of a structural frame included in the lighting system of FIG. 18.
Figure 20:
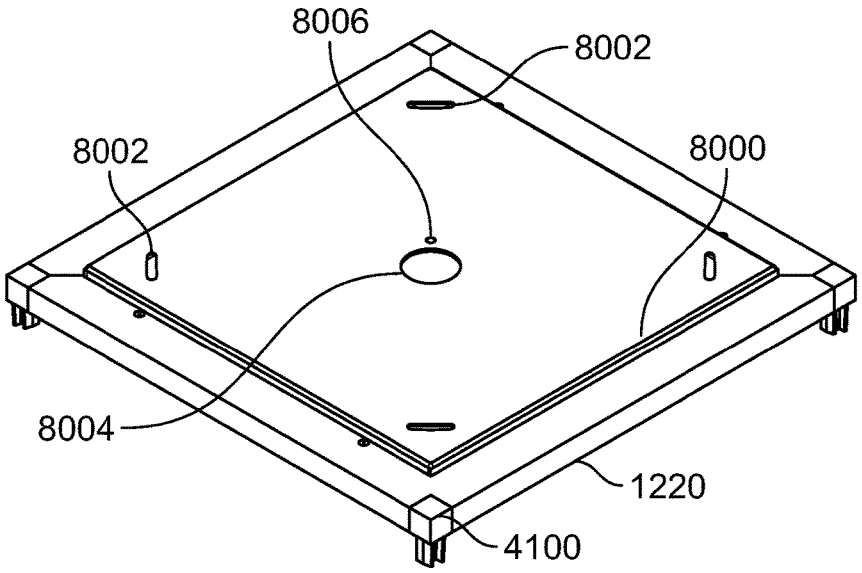
FIG. 20 is a perspective view illustrating the upper part of the structural frame of FIG. 19.
Figure 21:
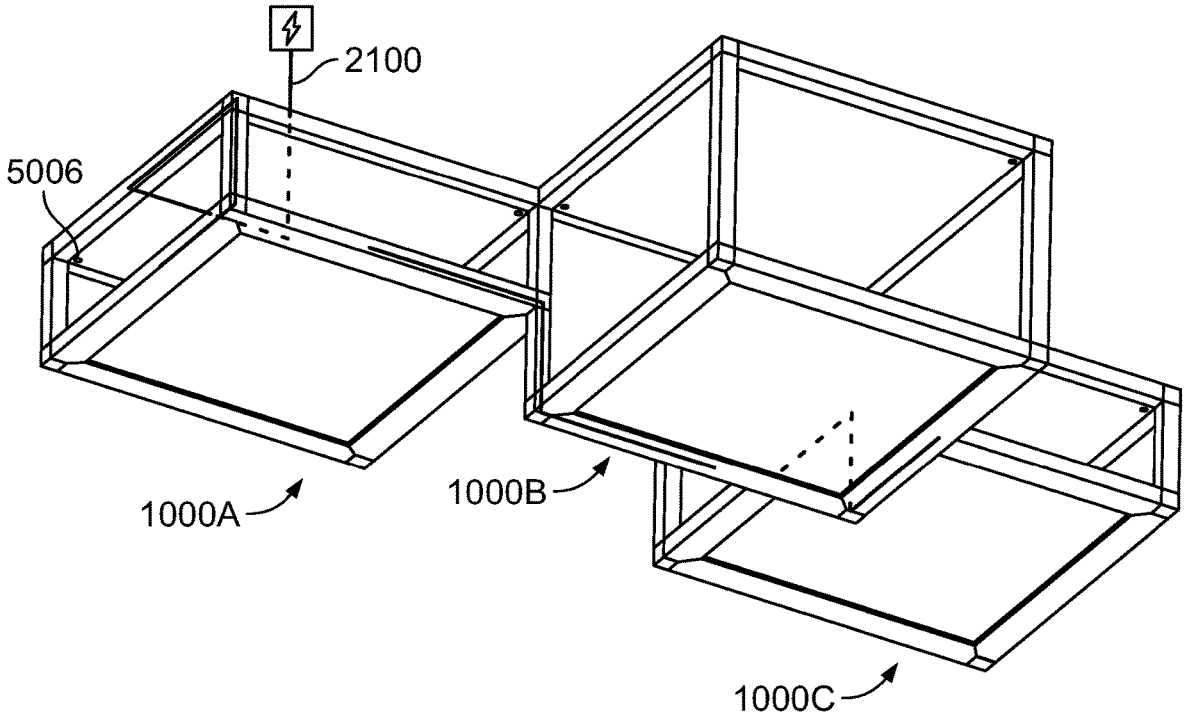
FIG. 21 is a perspective view illustrating a wiring diagram of the lighting system of FIG. 18.
Figure 22:
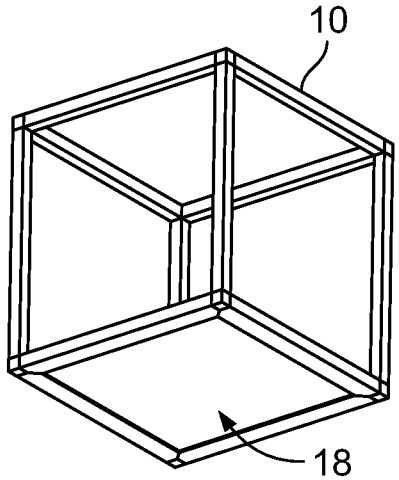
FIG. 22 is a perspective view illustrating a structural frame that can be included in a lighting system of the present invention.
Figure 23:
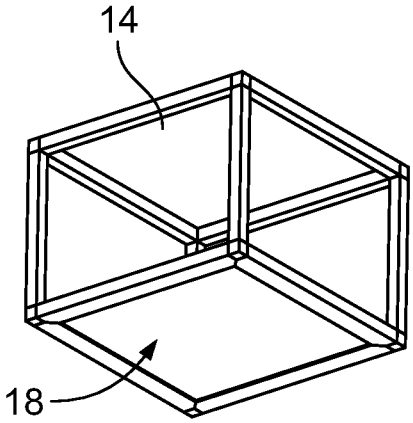
FIG. 23 is a perspective view illustrating a structural frame that can be included in a lighting system of the present invention.
Figure 24:
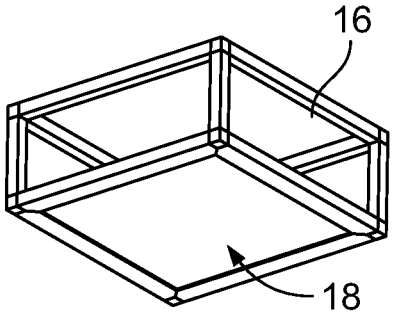
FIG. 24 is a perspective view illustrating a structural frame that can be included in a lighting system of the present invention.
Figure 25:
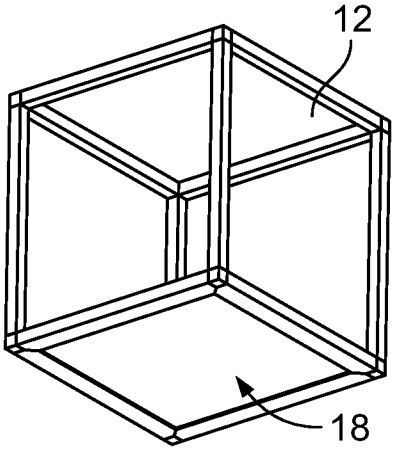
FIG. 25 is a perspective view illustrating a structural frame that can be included in a lighting system of the present invention.
Figure 26:
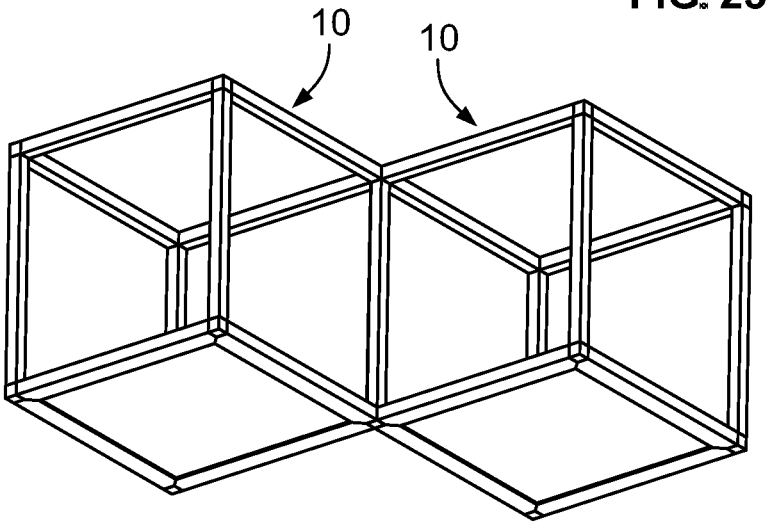
FIG. 26 is a perspective view illustrating a pair of structural frames joined edge-to-edge according to an exemplary embodiment of the present invention.
Figure 27:
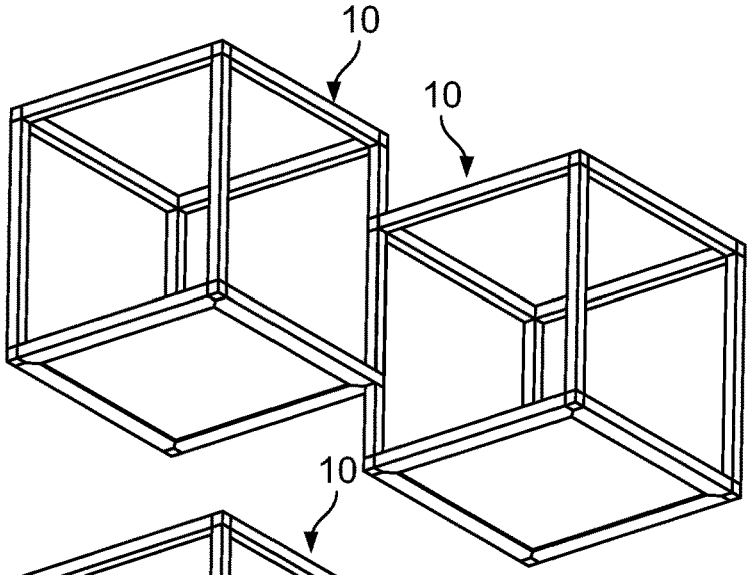
FIG. 27 is a perspective view illustrating a pair of structural frames joined edge-to-edge according to an exemplary embodiment of the present invention.
Figure 28:
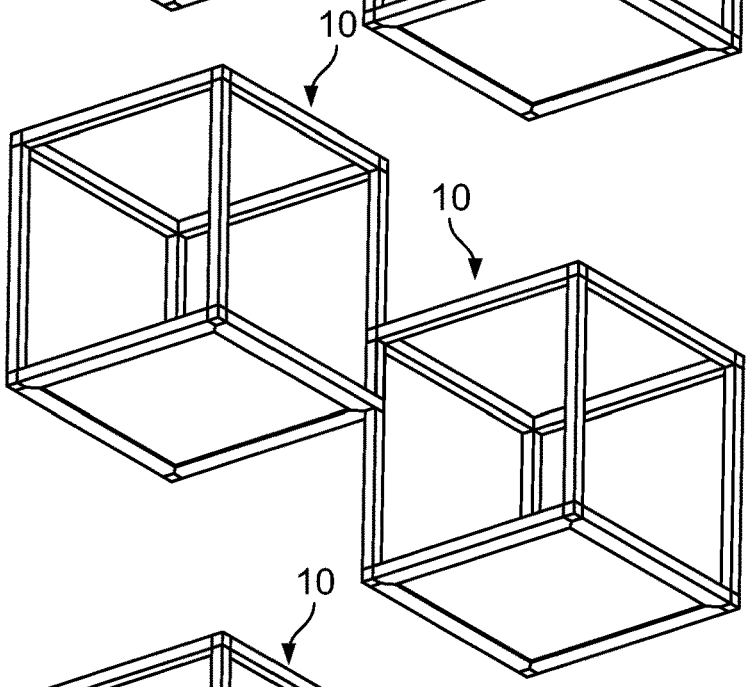
FIG. 28 is a perspective view illustrating a pair of structural frames joined edge-to-edge according to an exemplary embodiment of the present invention.
Figure 29:
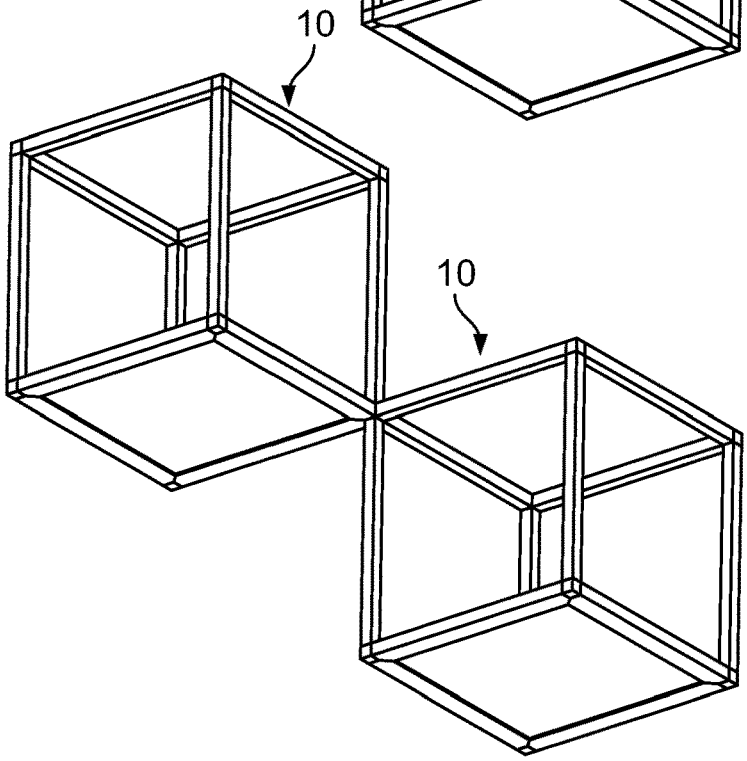
FIG. 29 is a perspective view illustrating a pair of structural frames joined edge-to-edge according to an exemplary embodiment of the present invention.
Figure 30:
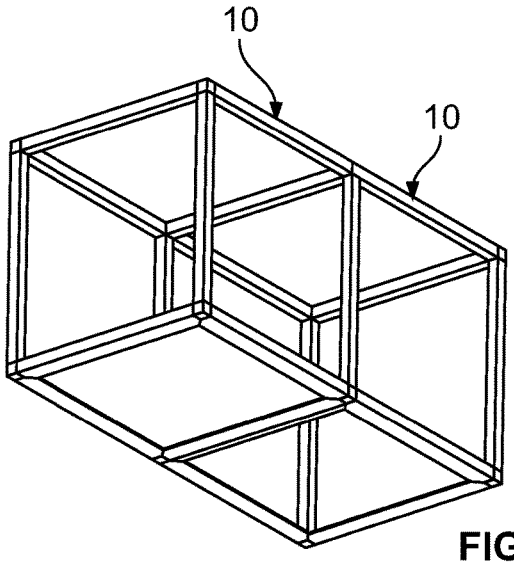
FIG. 30 is a perspective view illustrating a pair of structural frames joined face-to-face according to an exemplary embodiment of the present invention.
Figure 31:
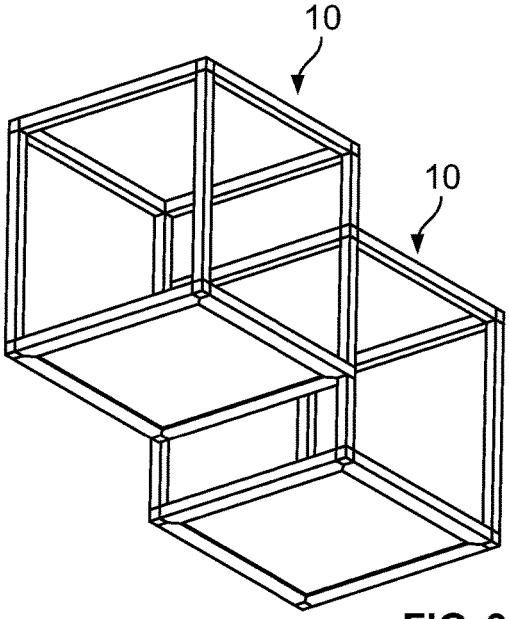
FIG. 31 is a perspective view illustrating a pair of structural frames joined face-to-face according to an exemplary embodiment of the present invention.
Figure 32:
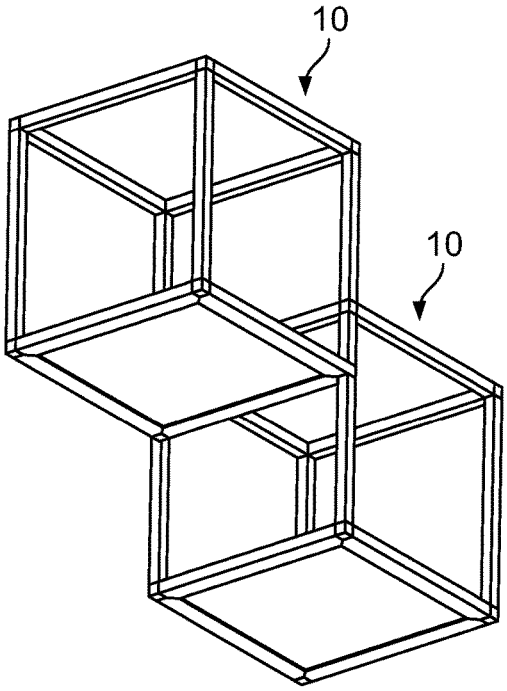
FIG. 32 is a perspective view illustrating a pair of structural frames joined face-to-face according to an exemplary embodiment of the present invention.
Figure 33:
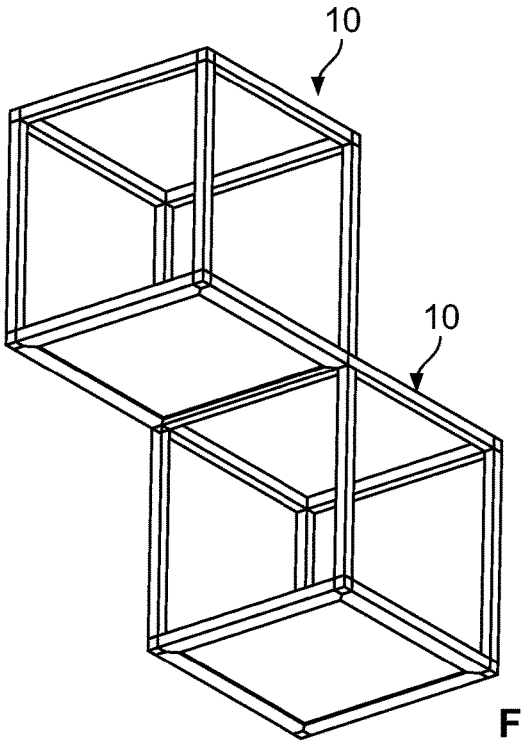
FIG. 33 is a perspective view illustrating a pair of structural frames joined face-to-face according to an exemplary embodiment of the present invention.

Referring to FIG. 20, each plate 8000 may be connected to one or more of its four adjacent arms 1220 and/or its four three-armed connectors 4100. Referring to FIG. 20, each plate 8000 may include a central opening 8004 configured to enable the power cable 2100 to extend downwardly from the ceiling into the respective structural frame, a plurality of slots 8002 and an opening 8006. As illustrated in FIG. 19, the slots 8002 and opening 8006 can be used to securely mount the plate 8000 to a ceiling via, for example, the plurality of fastener (or screws) 5006 and the screw 5008. A cover plate 8100 (see FIG. 19) may be selectively attached to the plate 8000 via a plurality of screws 5010 in order to conceal the opening 8004.

The cable 2100 may be disposed between the plates 8100 and 8000 in order to be concealed, and may enter the structural frame 1000A via any one of the arms 1220 at the top side of the structural frame 1000A. For example, an opening may be drilled (or pre-drilled) into one of the arms 1220 at the top side of the structural frame 1000A in order to fit the cable 2100 inside of said arm 1220. Once the cable 2100 is inserted inside of the arm 1220, it may be routed through the arms and connectors of the structural frame 1000A to transmit electrical power to the light emitting panels 3000, as described above for cable 210.

No cables need be inserted between the plates 8100 and 8000 of the structural frames 1000B and 1000C. The plates 8100 and 8000 of these structural frames serve to conceal the ceiling above and to provide a uniform appearance at the top of the lighting system.

While the lighting system of FIG. 18 is illustrated as including only three structural frames, the number, size, and arrangement of structural frames can be modified as needed using the teachings above, except that in the embodiment of FIG. 18 the top sides of the structural frames need be affixed to a ceiling. According to the teachings above, a hybrid lighting system can also be modularly devised where at least one of its structural frames is fixedly mounted to a ceiling and another one of the structural frames is suspended from the ceilings via cables, as described above.

FIGS. 22-25 depict various structural frames 10, 12, 14, 16 according to exemplary embodiments of the present disclosure. The structural frames 10, 12, 14, 16 can be of various heights, can include a light panel 18 and can be configured to be affixed to a ceiling or to be suspended from the ceiling, as described above. The structural frame 10 may be, for example, similar to the structural frame 100A, 1000A, or other structural frames described in this specification.

FIGS. 26-29 depict options for structural frames 10 to be connected at various heights (four height options are shown) to each other in an edge-to-edge configuration to create various lighting structures.

FIGS. 30-33 depict options for cubes 10 to be connected at various heights along the face of an adjacent cube 14 (four height options are shown) to each other to create various lighting configurations (e.g., a face-to-face configuration).

Figure 34:
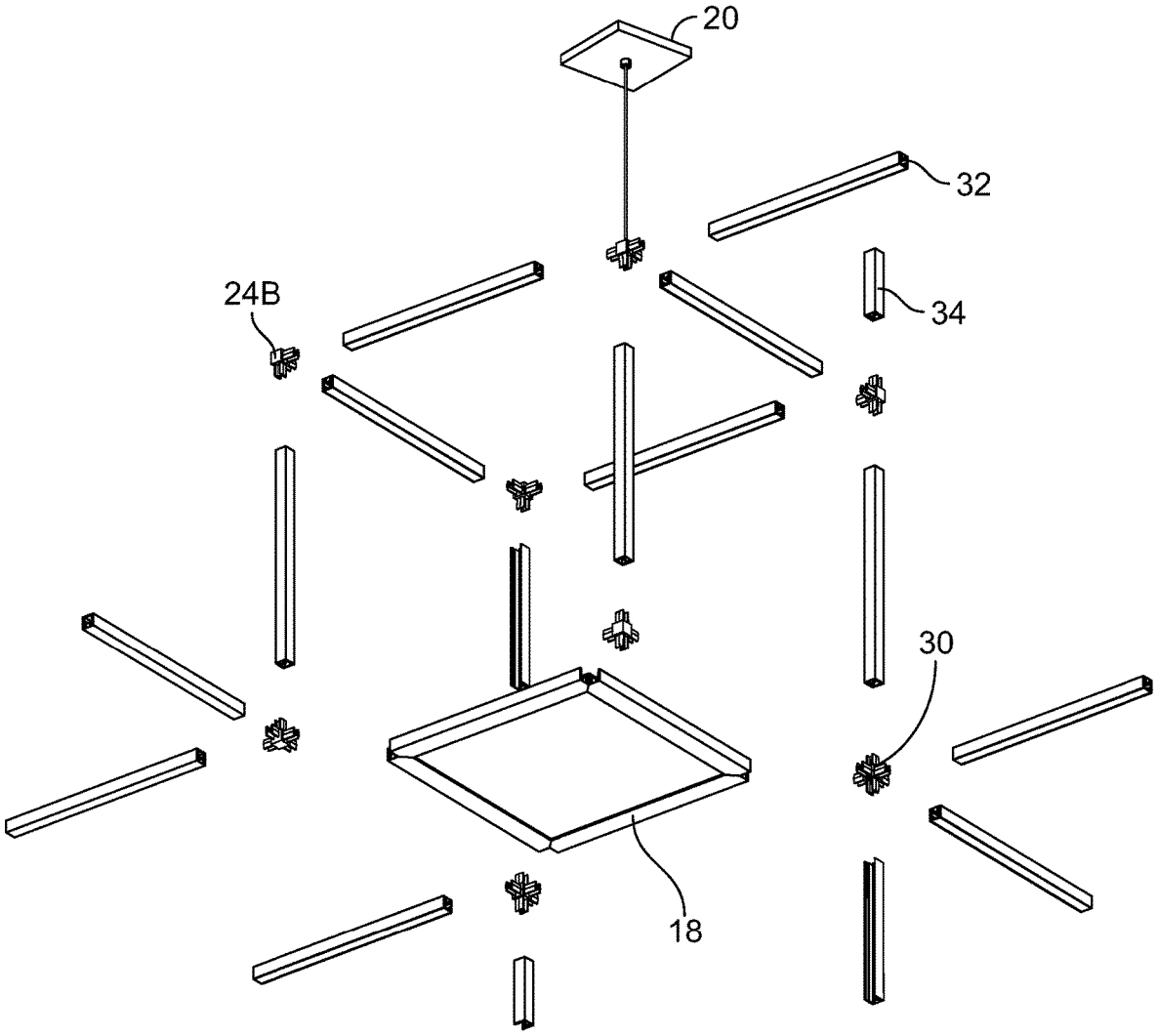
FIG. 34 is an exploded perspective view illustrating a plurality of components that can be utilized to assemble a lighting system of the present invention.

FIG. 34 is an exploded view of components of a cube (or structural frame) 10 that is depicted in described above. This includes a power cable 20, various connectors including three-arm connectors 24B, four-arm connectors, five-arm connectors and a six-arm connector 30, arms including a long arm 32, a medium arm 34 and a short arm and the light panel 18. The six-arm connector 30 may have a first pair of in-line arms extending in the direction X, a second pair of in-line arms extending in the direction Y, and a third pair of arms extending in line in the direction Z, with the base of the connector being disposed in the center, and the six arms extending from the base as described. For example, the six-arm connector 30 may be similar to the five-arm connector 490 of FIG. 14B, but the connector 30 may have one additional arm (which the connector 490 does not have), extending in the direction Y (see FIG. 14B).

Although the description above and accompanying drawings contains much specificity, the details provided should not be construed as limiting the scope of the embodiments, but merely as describing some of the features of the embodiments. The description and figures should not to be taken as restrictive and are understood as broad and general teachings in accordance with the present invention. While the embodiments have been described using specific terms, such description is for illustrative purposes only, and it is to be understood that modifications and variations to such embodiments, including, but not limited to, the substitutions of equivalent features and terminology may be readily apparent to those of skill in the art based upon this disclosure without departing from the spirit and scope of the invention.

What is claimed is:

1. A lighting system, comprising:

a plurality of structural frames including a first structural frame and a second structural frame, each of the structural frames including:

a plurality of arms extending in a first direction;

a plurality of arms extending in a second direction that is perpendicular to the first direction;

a plurality of arms extending in a third direction that is perpendicular to the first direction and the second direction;

a plurality of connectors connecting the arms that extend in the first direction, the arms that extend in the second direction and the arms that extend in the third direction to one another; and a light emitting panel connected at least to one of the first structural frame and the second structural frame, wherein at least one arm of the plurality of arms that extend in the first direction, the second direction and the third direction of the first structural frame and the second structural frame is shared by the first structural frame and the second structural frame such that the first structural frame and the second structural frame are adjoined to each other by the at least one arm that is shared and arm defines at least a part of each of the adjoining structural frames.

2. The lighting system of claim 1, wherein the at least one arm that shared defines an entire edge of the first structural frame and an entire edge of the second structural frame.

3. The lighting system of claim 1, wherein the first structural frame has a bottom end and the second structural frame has a bottom end, and the bottom end of the first structural frame is disposed at a same elevation as the bottom end of the first structural frame.

4. The lighting system of claim 1, wherein the first structural frame has a bottom end and the second structural frame has a bottom end, and the bottom end of the first structural frame is disposed at a first elevation and the bottom end of the second structural frame is disposed at a second elevation that is different from the first structural frame.

5. The lighting system of claim 1, wherein at least one arm selected from the group comprising the plurality of arms of the first structural frame that extend in the first direction, the plurality of arms of the first structural frame that extend in the second direction, and the plurality of arms of the first structural frame that extend in the third direction includes an interior cavity extending therethrough.

6. The lighting system of claim 5, further comprising an electrical cable extending through the interior cavity of the at least one arm of the first structural frame and connected to transmit power to the light emitting panel.

7. The lighting system of claim 1, further comprising a second light emitting panel connected to the other of the first structural frame and the second structural frame to which the light emitting panel is not connected.

8. The lighting system of claim 1, further comprising a plurality of suspension cables connected to at least one of the first structural frame and the second structural frame and configured to suspend at least one of the first structural frame and the second structural frame from a surface.

9. The lighting system of claim 1, wherein at least one of the first structural frame and the second structural frame is directly connected to a surface.

10. A lighting system, comprising:

a plurality of structural frames, that each include a plurality of arms spaced from each other and extending in a first direction, a plurality of arms extending in a second direction that is perpendicular to the first direction, a plurality of arms extending in a third direction that is perpendicular to the first direction and the second direction and a plurality of connectors connecting the arms that extend in the first direction, the arms that extend in the second direction and the arms that extend in the third direction to one another with a light emitting panel connected to at least one of the structural frames, wherein the structural frames share at least one connector, from among the respective pluralities of connectors with the at least one connector that is shared adjoining at least one of the arms of the structural frames with at least one of the arms of another structural frame.

* * * * *